US010676964B2

(12) United States Patent
Milligan

(10) Patent No.: US 10,676,964 B2
(45) Date of Patent: Jun. 9, 2020

(54) CABINET GANG LOCK SYSTEM FOR ELECTRICALLY LOCKABLE SLIDES

(71) Applicant: Accuride International Inc., Santa Fe Springs, CA (US)

(72) Inventor: Charles A. Milligan, Santa Fe Springs, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 1089 days.

(21) Appl. No.: 14/451,326

(22) Filed: Aug. 4, 2014

(65) Prior Publication Data

US 2015/0035294 A1 Feb. 5, 2015

Related U.S. Application Data

(60) Provisional application No. 61/861,839, filed on Aug. 2, 2013.

(51) Int. Cl.
*E05B 47/00* (2006.01)
*E05B 65/464* (2017.01)
(Continued)

(52) U.S. Cl.
CPC ..... *E05B 47/0012* (2013.01); *E05B 65/462* (2013.01); *E05B 65/464* (2013.01);
(Continued)

(58) Field of Classification Search
CPC ..... E05B 63/143; E05B 65/46; E05B 65/462; E05B 65/464; E05B 47/0012; E05C 9/00;
(Continued)

(56) References Cited

U.S. PATENT DOCUMENTS 1,073,274 A * 9/1913 Millice ..... E05B 65/462
292/DIG. 18
1,515,611 A * 11/1924 O'Connor ..... E05B 13/108
292/DIG. 68
(Continued)

FOREIGN PATENT DOCUMENTS

AU 2008258156 A1 7/2009
CN 1782315 A 6/2006
(Continued)

OTHER PUBLICATIONS

Extended European Search Report (EESR) on related European Patent Application No. 14832520.2 from European Patent Office (EPO) dated Jul. 26, 2016.
(Continued)

*Primary Examiner* — Kristina R Fulton
*Assistant Examiner* — Faria F Ahmad
(74) *Attorney, Agent, or Firm* — Klein O'Neill & Singh, LLP

(57) ABSTRACT

A locking system, for a cabinet having a plurality of drawers extendably mounted in an interior of the cabinet, includes a bar and a motor unit. The bar is movable to prevent at least some of the drawers from extending out of the cabinet when in a locked position and allowing at least one of the drawers to extend out of the cabinet in an unlocked position. The motor unit is configured to drive an arm coupled to the bar, the arm being drivable to change a position of the bar from the locked position to the unlocked position.

12 Claims, 64 Drawing Sheets

(51) Int. Cl.

| | |
|---|---|
| ***E05B 65/462*** | (2017.01) |
| ***E05C 9/02*** | (2006.01) |
| ***E05C 9/00*** | (2006.01) |
| ***E05C 1/02*** | (2006.01) |
| ***E05B 65/46*** | (2017.01) |
| ***E05C 9/10*** | (2006.01) |
| ***E05C 1/06*** | (2006.01) |
| ***E05B 63/14*** | (2006.01) |

(52) U.S. Cl.

CPC ..... *E05B 63/143* (2013.01); *E05B 65/46* (2013.01); *E05B 2047/002* (2013.01); *E05C 1/02* (2013.01); *E05C 1/06* (2013.01); *E05C 9/00* (2013.01); *E05C 9/02* (2013.01); *E05C 9/10* (2013.01); *Y10T 292/08* (2015.04); *Y10T 292/0801* (2015.04); *Y10T 292/084* (2015.04); *Y10T 292/0834* (2015.04); *Y10T 292/0843* (2015.04); *Y10T 292/0845* (2015.04); *Y10T 292/0961* (2015.04); *Y10T 292/0962* (2015.04); *Y10T 292/0964* (2015.04); *Y10T 292/0966* (2015.04); *Y10T 292/1016* (2015.04); *Y10T 292/1021* (2015.04); *Y10T 292/1082* (2015.04)

(58) Field of Classification Search

CPC ..... E05C 9/02; E05C 9/10; E05C 1/02; E05C 1/06; Y10T 292/0834; Y10T 292/084; Y10T 292/0964; Y10T 292/1016; Y10T 292/1021; Y10T 292/08; Y10T 292/0801; Y10T 292/0836; Y10T 292/0843; Y10T 292/0845; Y10T 292/0961; Y10T 292/0962; Y10T 292/0966; Y10S 292/18

USPC .... 292/32, 37, 159, 140, 144, DIG. 18, 2, 3, 292/33, 39, 41, 156, 157; 70/77–88, 70/278.7, 279.1, 280–282; 312/216, 217, 312/218, 219, 221

See application file for complete search history.

(56) References Cited

U.S. PATENT DOCUMENTS

| | | | | | |
|---|---|---|---|---|---|
| 1,951,628 | A * | 3/1934 | Prost | E05B 65/104 | 126/287.5 |
| 3,033,634 | A | 5/1962 | Ribbens et al. | | |
| 3,404,929 | A * | 10/1968 | Wright | E05B 65/463 | 312/216 |
| 4,246,769 | A * | 1/1981 | McLaughlin | E05B 65/462 | 292/165 |
| 4,691,948 | A | 9/1987 | Austin, Jr. et al. | | |
| 5,184,887 | A * | 2/1993 | O'Keefe | E05B 65/464 | 312/219 |
| 5,257,860 | A * | 11/1993 | Slivon | E05B 65/462 | 312/218 |
| 5,313,518 | A | 5/1994 | Yamashita | | |
| 5,385,039 | A * | 1/1995 | Feldpausch | E05B 65/462 | 312/219 |
| 5,702,167 | A * | 12/1997 | Muller | E05B 65/464 | 312/217 |
| 5,805,074 | A | 9/1998 | Warren et al. | | |
| 5,820,234 | A * | 10/1998 | Capwell | E05B 65/462 | 312/216 |
| 5,862,689 | A | 1/1999 | Wen | | |
| 5,946,953 | A | 9/1999 | Feldpausch | | |
| 6,116,067 | A * | 9/2000 | Myers | B25H 3/028 | 292/341.16 |
| 6,244,084 | B1 | 6/2001 | Warmack | | |
| 6,282,931 | B1 | 9/2001 | Padiak et al. | | |
| 6,341,511 | B1 | 1/2002 | Snoke et al. | | |
| 6,374,649 | B1 * | 4/2002 | Holcomb | E05B 65/468 | 312/215 |
| 6,698,258 | B2 | 3/2004 | Westwinkel | | |
| 6,722,167 | B1 | 4/2004 | Hsu | | |
| 6,739,164 | B2 | 5/2004 | Warmack | | |
| 6,746,091 | B2 | 6/2004 | Friar et al. | | |
| 7,500,572 | B2 | 3/2009 | Lane et al. | | |
| 7,891,222 | B2 * | 2/2011 | Ratkus | E05B 47/0012 | 70/278.7 |
| 8,740,319 | B1 * | 6/2014 | Davis | E05B 65/462 | 312/216 |
| 8,833,118 | B1 * | 9/2014 | McLane | E05C 1/08 | 70/85 |
| 8,876,172 | B2 * | 11/2014 | Denison | E05B 47/0012 | 292/144 |
| 9,382,730 | B1 * | 7/2016 | Chen | E05B 65/462 | |
| 9,631,399 | B1 * | 4/2017 | Zhang | E05B 47/00 | |
| 2002/0165641 | A1 * | 11/2002 | Manalang | A61G 12/001 | 700/237 |
| 2003/0076016 | A1 * | 4/2003 | Westwinkel | E05B 65/464 | 312/221 |
| 2005/0199022 | A1 | 9/2005 | Friar et al. | | |
| 2007/0050051 | A1 * | 3/2007 | Chang | E05B 47/026 | 700/17 |
| 2007/0085348 | A1 * | 4/2007 | Nye-Hingston | E05B 15/0205 | 292/144 |
| 2008/0246286 | A1 * | 10/2008 | Ostrowski | E05B 47/0011 | 292/144 |
| 2009/0102333 | A1 * | 4/2009 | Weng | A47B 95/02 | 312/222 |
| 2009/0235767 | A1 * | 9/2009 | Garneau | E05B 47/0012 | 74/56 |
| 2010/0123375 | A1 * | 5/2010 | Romaen | E05B 65/462 | 312/215 |
| 2010/0301996 | A1 * | 12/2010 | Stradiota | E05B 47/00 | 340/5.53 |
| 2011/0005283 | A1 | 1/2011 | Sevillano | | |
| 2011/0109209 | A1 * | 5/2011 | King | E05B 47/0665 | 312/216 |
| 2011/0185779 | A1 | 8/2011 | Crass et al. | | |
| 2012/0038255 | A1 * | 2/2012 | Netzer | E05B 65/46 | 312/319.1 |
| 2014/0167574 | A1 * | 6/2014 | Shoenfeld | A47B 81/00 | 312/215 |
| 2014/0210329 | A1 * | 7/2014 | Brunnmayr | E05B 65/46 | 312/333 |
| 2015/0001860 | A1 * | 1/2015 | Muller | E05B 65/462 | 292/140 |
| 2016/0024817 | A1 * | 1/2016 | Denison | E05B 47/0012 | 70/85 |
| 2016/0049034 | A1 * | 2/2016 | Stradiota | G07C 9/00563 | 340/5.53 |
| 2016/0123039 | A1 * | 5/2016 | Roatis | E05B 65/462 | 70/78 |
| 2016/0303732 | A1 * | 10/2016 | Tam | A47B 81/00 | |
| 2018/0073275 | A1 * | 3/2018 | Ullrich | E05B 17/0066 | |
| 2018/0368573 | A1 * | 12/2018 | Chen | E05B 65/46 | |

FOREIGN PATENT DOCUMENTS

| | | | | |
|---|---|---|---|---|
| CN | 101720375 | A | 6/2010 | |
| CN | 102535995 | A | 7/2012 | |
| DE | 3700966 | A1 * | 9/1987 | E05B 65/462 |
| DE | 9105416 | U1 * | 7/1991 | E05B 65/462 |
| DE | 9209667 | U1 * | 9/1993 | E05B 65/463 |
| DE | 29520732 | U1 * | 4/1996 | A47B 88/16 |
| EP | 1128009 | A2 * | 8/2001 | E05B 65/0014 |
| EP | 1336709 | A1 * | 8/2003 | E05B 65/464 |
| EP | 2463827 | A2 | 6/2012 | |
| GB | 2429493 | A | 2/2007 | |
| JP | H09303027 | A | 11/1997 | |
| JP | 3177447 | B2 | 6/2001 | |
| JP | 2007-177409 | A | 7/2007 | |

(56) References Cited

FOREIGN PATENT DOCUMENTS

| | | | |
|---|---|---|---|
| KR | 10-2012-0010445 | A | 2/2012 |
| KR | 20120010445 | A | 2/2012 |

OTHER PUBLICATIONS

International Search Report on related PCT Application No. PCT/US2014/049645 from International Searching Authority (KIPO) dated Nov. 28, 2014.
Written Opinion on related PCT Application No. PCT/U52014/049645 from International Searching Authority (KIPO) dated Nov. 28, 2014.
Office action on related Chinese Patent Application No. 201480042886.4 from State Intellectual Property Office (SIPO) dated Dec. 27, 2016.
Office action on related Chinese Patent Application No. 201480042886.4 from State Intellectual Property Office (SIPO) dated Jan. 29, 2018.

* cited by examiner

CABINET GANG LOCK SYSTEM FOR ELECTRICALLY LOCKABLE SLIDES

CROSS REFERENCE TO RELATED APPLICATIONS

This application claims the benefit of the filing of U.S. Provisional Patent Application No. 61/861,839, filed on Aug. 2, 2013, the disclosure of which is incorporated by reference herein.

BACKGROUND OF THE INVENTION

The present invention relates generally to cabinet locking systems, and more particularly to cabinet gang-lock systems.

Cabinets are often used to hold a variety of items in a convenient manner, with drawers of the cabinet extensible to allow for easy access to contents held by the drawers. At times, however, security for contents of the cabinet is also desired, so locks are sometimes provided for the cabinet drawers. One type of lock which may be used is a gang-lock, which commonly locks and unlocks all of the drawers of a cabinet in unison.

Gang locks are commonly mechanical devices, for example utilizing a vertical bar having pins to prevent opening of drawers in the locked position, with the bar maintained in the locked position by way of a key lock. When a user desires access to the drawers, the user unlocks the lock and physically operates a mechanical linkage to lift the vertical bar, moving the pins to positions allowing for opening of the drawers.

Relying on a user's motive power to operate the locking system may not always be desirable. Unfortunately, incorporation of powered devices to perform such operations may be difficult, for example due to limited available space within a cabinet, complication of installation, or other issues.

BRIEF SUMMARY OF THE INVENTION

Aspects of the invention provide for electronic locking of multiple slides, for example using a gang lock or interlock.

One aspect of the present invention provides a locking system for a cabinet including a plurality of drawers extendably mounted in an interior of the cabinet, the locking system comprising: a bar movable to prevent at least some of the drawers from extending out of the cabinet when in a locked position and allowing at least one of the drawers to extend out of the cabinet in an unlocked position, and a motor unit to drive an arm coupled to the bar, the arm being drivable to change a position of the bar from the locked position to the unlocked position.

Another aspect of the invention provides a locking system for a housing, the housing containing a plurality of inner slide members mounted in an interior of the housing, the locking system including: a restricting element movable to prevent at least more than one of the inner slide members from sliding at least partially out of the housing when in a locked position and allowing at least one of the slides to slide out of the housing in an unlocked position; and an electrically powered driving unit coupled to the restricting element, and drivable to shift a position of the restricting element from the locked position to the unlocked position.

Another aspect of the invention provides a drawer locking system for a plurality of drawers, the drawer locking system comprising: a locking element movable to prevent access to an interior of at least some of the drawers when in a locked position and allowing access to the interior of at least one of the drawers in an unlocked position; and an electronic unit to drive the locking element to shift from the locked position to the unlocked position.

These and other aspects of the invention are more fully comprehended upon review of this disclosure.

BRIEF DESCRIPTION OF THE FIGURES

In FIG. 15 the slides are shown as integrating a close-assist device. The movable track and hooks can be comprised of metal, or a composite including a reinforced polymer to conserve weight but maintain strength. The cam arm displaces the movable track and subsequently the attached hooks. The channel is fixed, and guides the movable track.

As shown in FIG. 16, a movable track is in a guide channel. Track hooks and a lift platform are inserted in slots in the moveable track, with brackets attached to the slide including a gap to receive the hooks. The design allows for incremental positioning of the track hooks for adjusting to the location of the slides. Incremental adjustments are approximately 1 inch in some embodiments. The track hooks snap and lock into place in the track. Similarly, the lift platform also attaches to the movable track and locks into place.

FIG. 38 shows the lever arm in the up position and the extension of the flywheel not engaged with the contact switch.

DETAILED DESCRIPTION

Figure 1:
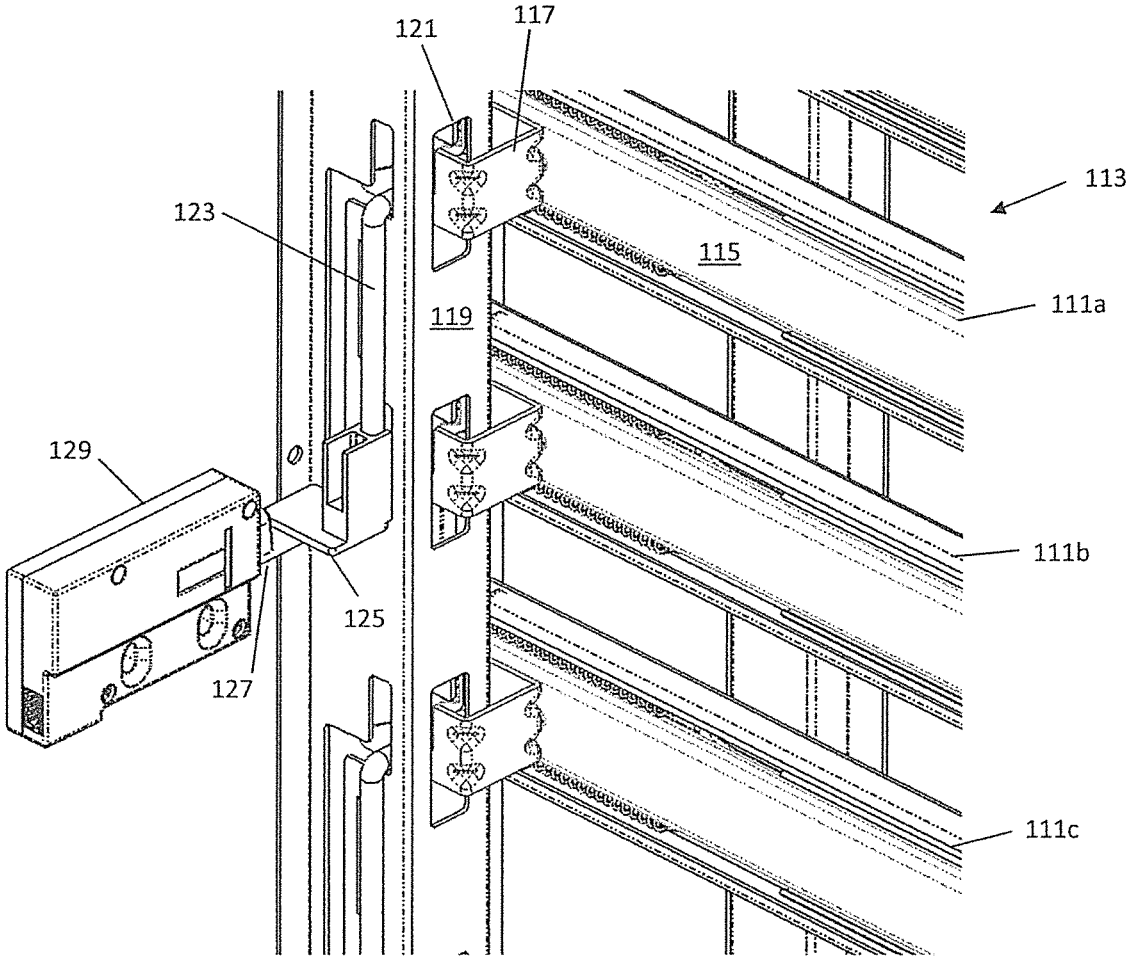
FIG. 1 is an isometric view of portions gang lock device in accordance with aspects of the invention within a cabinet structure. The figure shows a gang lock mechanism in a down and locked position. The mechanism is mounted at a rear of the cabinet. Fixed brackets are attached to the slides and engage with a serpentine rod located within a channel through which the serpentine rod passes. The channel is fixed in position. A lock cam arm, when rotated by a motor, vertically displaces the serpentine rod away from the fixed brackets by lifting an interconnecting lift platform attached to the serpentine rod. The cam arm displaces the serpentine rod and the components attached to the rod. This design also allows for the use of multiple slide cross-sections with multiple performance features. These slides shown in FIG. 1 are shown as including a close-assist device. The serpentine rod can be comprised of metal, or a composite including a reinforced polymer to conserve weight but maintain strength.

FIG. 1 illustrates a portion of a gang-lock system for a cabinet in accordance with aspects of the invention. In FIG. 1, drawer slides 111*a-c* are mounted to a side wall of a cabinet 113 or other enclosure. Drawers (not shown) are generally mounted to an inner slide member, for example inner slide member 115, with the inner slide member at least partially extendable from the cabinet, allowing access to contents of a drawer. As illustrated in FIG. 1, the drawer slide is a telescopic drawer slide, with an outer slide member having a longitudinal web longitudinally bounded by raceway channels, within which is a similar intermediate slide member, within which is the similar inner slide member. In various embodiments other drawer slides, for example over-and-under drawer slides, may be used instead.

A bracket 117 is mounted to a rear of the inner slide member, with the bracket opening and having a leg offset from the inner slide member and extending to the rear of the slide. The leg includes a slot (shown, e.g., in FIG. 5) for engaging with a retaining mechanism. As illustrated in FIG. 1, the bracket is a U-bracket, with an exterior surface of another leg mounted to the slide member, but other structures, such as other brackets mounted to the slide member, bayonet-type structures extending or punched out of the slide member, or other structures may also be used in various embodiments. In most embodiments, the rear of the inner slide member, when mounted to a drawer, extends beyond the rear of the drawer, with the bracket positioned behind a rear wall of the drawer.

With the inner slide member in the closed position, namely the non-extended position, the leg offset from the inner slide member extends into a channel 119 through an aperture 121 in the channel. The channel is fixed in position with respect to the cabinet. A serpentine rod 123 snakes in and out of the channel, with portions of the rod positionable in the slot of the leg of each bracket mounted to the inner slide members. With the rod in the slots of the brackets, the inner slide members are retained in the closed position, with the drawers closed and effectively locked.

A platform 125 is coupled to the serpentine rod. A cam arm 127, driven by a motor unit 129, is under the platform. Operation of the motor unit drives the cam arm to raise the platform, and therefore the serpentine rod, such that the serpentine rod exits the slot in the bracket mounted to the inner slide member. With the rod free of the slot, the inner slide members may be extended, and the drawers are unlocked.

Figure 2:
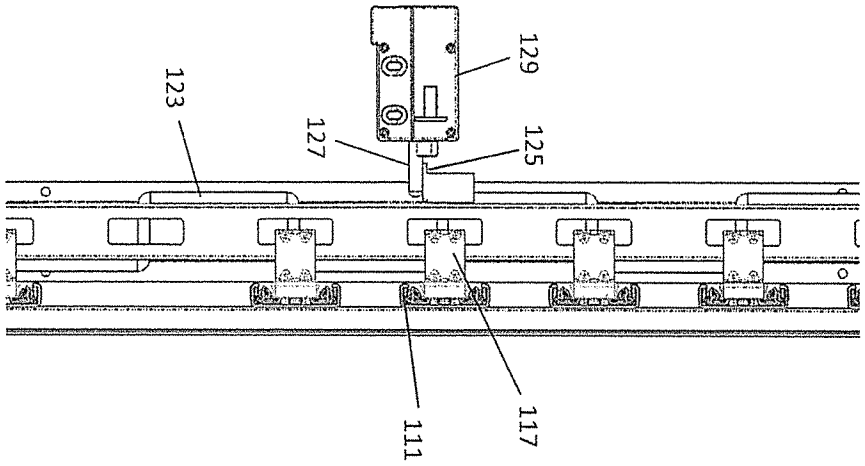
FIG. 2 is a front view of the gang lock device of FIG. 1. The figure shows the gang lock mechanism in the down and locked position. The mechanism is mounted at the rear of the cabinet. The cam arm is located under the lift platform attached to the serpentine rod.

FIG. 2 illustrates a front view of the portion of a gang-lock system for a cabinet shown in FIG. 1 in accordance with aspects of the invention. The motor unit 129 has rotated the cam arm 127 to the locked position. The platform 125 has come to rest on top of the cam arm 127 after the serpentine rod 123 has lowered under the force of gravity. The serpentine rod 123 is engaged with the bracket 117 placing the system in a locked position. In the locked position, the drawer slide 111 is prevented from moving by the engagement of the bracket 117, which is mounted to the drawer slide 111, with the serpentine rod 123.

Figure 3:
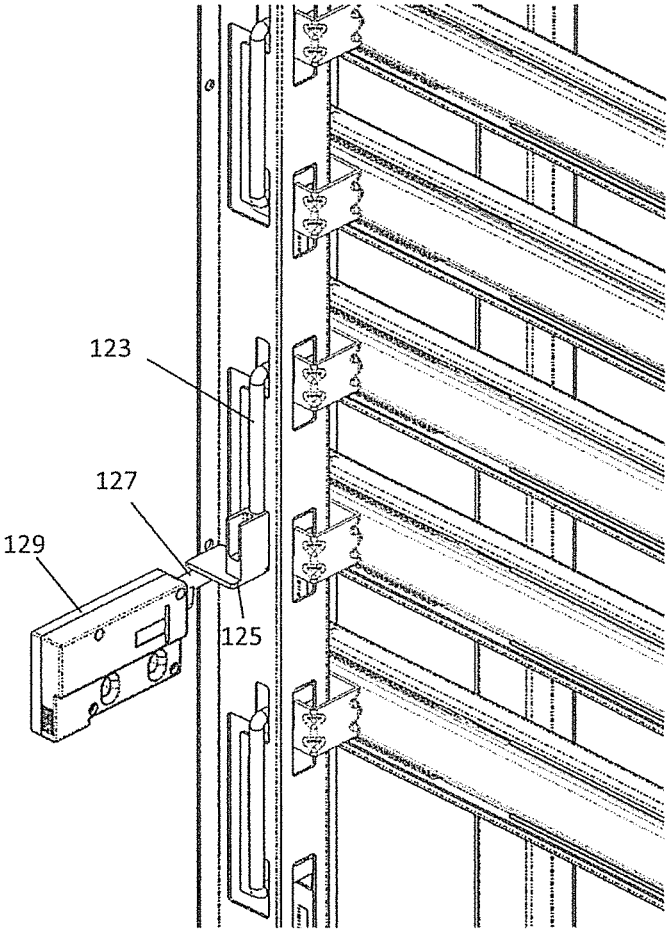
FIG. 3 is an isometric view of the gang lock device of FIG. 1 showing the gang lock mechanism in the up and unlocked position.

FIG. 3 illustrates a perspective view of the portion of a gang-lock system for a cabinet shown in FIG. 1 in accordance with aspects of the invention. The motor unit 129 has rotated the cam arm 127 to a raised position. The platform 125, coupled to the serpentine rod 123 by a channeled engagement, has moved vertically. The vertical movement has caused the serpentine rod 123 to disengage from the brackets 117, placing the system in an unlocked position.

Figure 4:
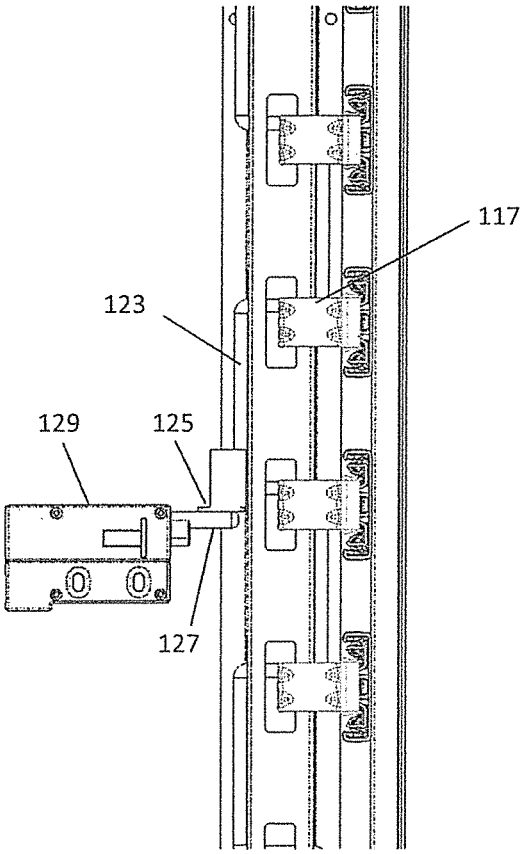
FIG. 4 is a front view of gang lock device of FIG. 1 showing the gang lock mechanism in the up and unlocked position.

FIG. 4 illustrates a front view of the portion of a gang-lock system for a cabinet shown in FIG. 3 in accordance with aspects of the invention. The motor unit 129 has rotated the cam arm 127 to a raised position. The platform 125, coupled to the serpentine rod 123 by a channeled engagement, has moved vertically. The vertical movement has caused the serpentine rod 123 to disengage from the brackets 117, placing the system in an unlocked position.

Figure 5:
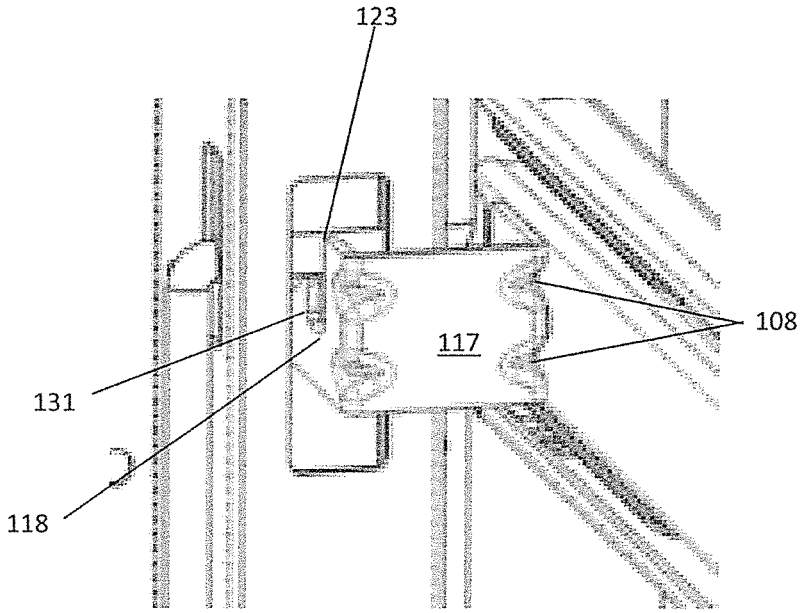
FIG. 5 is a close-up view of a portion of the gang lock device of FIG. 1, showing a portion of the serpentine rod about a slot in the bracket coupled to an inner slide member.

FIG. 5 illustrates a perspective detail view of the portion of a gang-lock system for a cabinet shown in FIG. 3 in accordance with aspects of the invention. The serpentine rod 123 is lifted above the bracket 117, and specifically a hook portion 131 of the bracket 117. The detail view shows the triangular shape of the hook portion 131, as well as a rectangular cut out 118 of the bracket 117, which forms the eye of the hook, and in which the serpentine rod 123 rests. A plurality of gussets 108 arranged along the bent corners of the bracket 117, increase the strength of the bracket 117.

Figure 6:
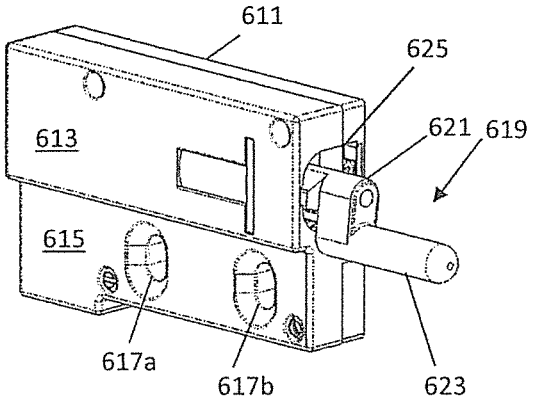
FIG. 6 is an isometric view of a motor unit and cam arm which may be used in the gang lock device of FIG. 1.
Figure 10:
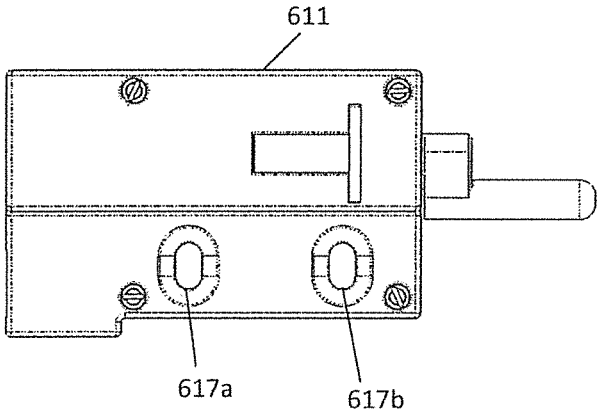
FIG. 10 is a side view of the motor unit and cam arm of FIG. 6, showing vertical mounting slots for attaching the motor unit to a cabinet wall or other supporting structures within the cabinet. The slots allow for vertical adjustment to ensure complete release and/or engagement of the gang lock device.

FIG. 6 illustrates a motor unit in accordance with aspects of the invention. The motor unit includes a casing 611 with a wider upper portion 613 and a narrower lower portion 615. The narrower lower portion includes a pair of mounting apertures 617*a,b* for mounting to a wall or frame of a cabinet, as may also be seen in FIG. 10. Preferably, and as shown in FIG. 6, the mounting apertures are in the form of slots, allowing for vertical adjustment when mounting the motor unit. In some embodiments the narrower lower portion has a width sized to fit within a width of a space between a drawer and a cabinet sidewall, a space which may be partially filled with a drawer slide and is sometimes called a side space, generally ½ inch wide. In some such embodiments the wider top portion has a height expected to fit into a vertical gap between drawers in a cabinet.

A rotatable cam arm 619 extends forward from an opening 625 of the casing. The rotatable cam arm may be driven to rotate from a motor (not shown in FIG. 6) within the casing, with the motor driving for example a spindle, causing rotation of a cam 621 of the cam arm, with an arm 623 of the cam arm extending from a protruding portion of the cam. In some embodiments the cam arm may simply comprise the cam, without inclusion of the arm, but in some embodiments inclusion of the arm 623 allows for increased area of contact for weight bearing, as well as increasing tolerance of positioning of the motor unit as a whole.

Figure 7:
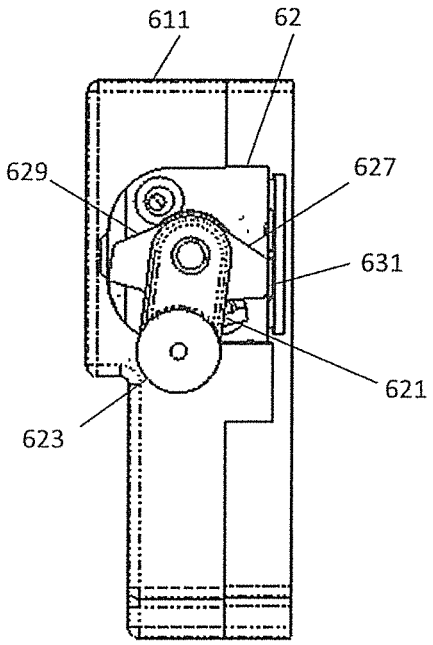
FIG. 7 is a front view of a motor unit of FIG. 6 with a rotating cam arm in the lowest position. Features integral to the rotating cam arm provide a contact pad to engage with contact switches. The stepped profile allow for use of a higher torque motor for increased load capacity. In some embodiments the thinner section fits within a ½ inch side space to complement the installation of a ½ inch side space slide if mounted on the side wall of the cabinet. The upper wider portion would fit within the typical gap between a series of vertically mounted drawers.

FIG. 7 illustrates a front view of the motor unit of FIG. 6. The casing 611 includes the opening 625 on a front surface, with the cam 621 at the end of a spindle (not shown) extending through the opening. The arm 623 is about an end of the cam, shown in FIG. 7 in its lowest position.

Also visible in FIG. 7 are first and second cam stops 627 and 629 extending radially from the spindle. As shown in FIG. 7, the second cam stop is abutting and in contact with a first contact sensor 631. The first contact sensor is electrically coupled to control circuitry for operating a motor driving the cam arm by way of the spindle. In some embodiments, a photoelectric sensor in the casing 611 is triggered (or not triggered) when the first cam stop 627, second cam stop 629, or other portions of the cam is in a predefined position.

Figure 8:
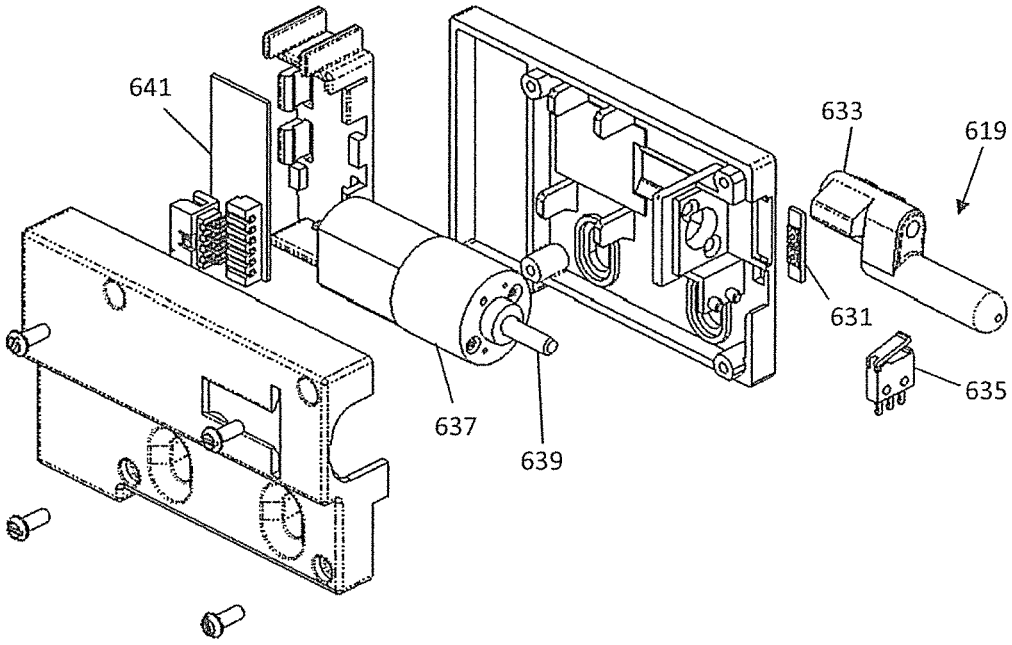
FIG. 8 is an exploded view of the motor unit and cam arm of FIG. 6, showing a motor control circuit, miniature gear motor, rotating cam arm, lock status switch and contact switches for stopping the motor at the fully rotated up and fully rotated down positions.
Figure 9:
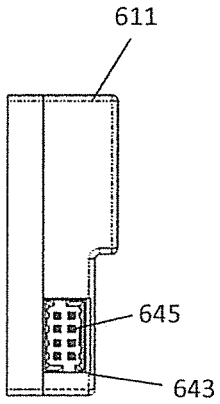
FIG. 9 is a rear view of the motor unit of FIG. 6 showing an on board electrical connector.

FIG. 8 is an exploded view of the motor unit of FIG. 6. As can be seen in FIG. 8, the motor unit includes a motor 637, with an extending spindle 639 for providing rotational motive force to the cam arm 619. In the embodiment shown, the spindle mounts to a socket extending from the cam of the cam arm, with the first and second cam stops integrally formed of the socket. In addition, not visible in the view of FIG. 7, but shown in FIG. 8, a second contact sensor 635 is positioned within the casing such that the first cam stop abuts and contacts the second contact sensor when the cam arm is in a highest position. The second contact sensor, like the first contact sensor, is electrically coupled to control circuitry mounted on a board 641 within the casing. As may be seen in FIG. 9, an electrical connector 645 of the contact board is accessible by way of a further opening 643 in the casing 611.

Figure 11:
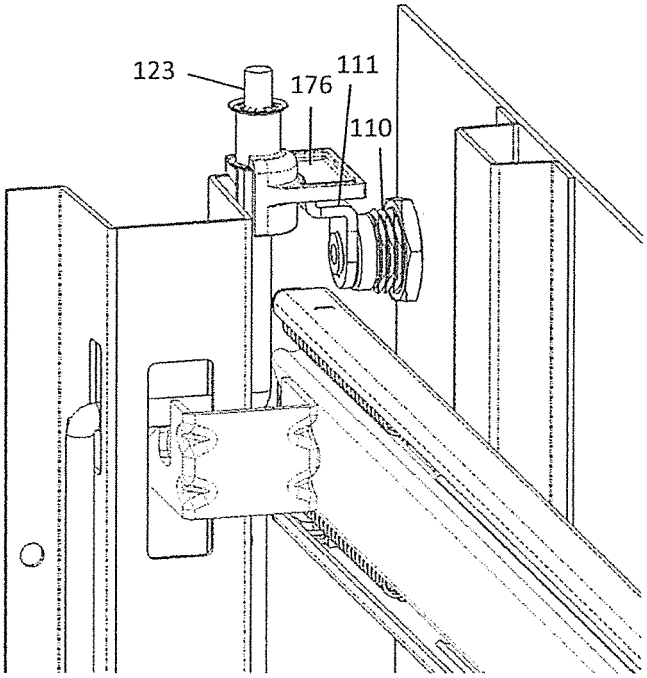
FIG. 11 illustrates a gang lock device such as the device of FIG. 1 with an optional cam key lock for mechanical activation in the event of a power loss. The mechanical lock vertically displaces the serpentine rod independent of the electronic gang lock. The view shows the rod in the unlocked position. This is an inside view of the cabinet structure, showing a side wall of the cabinet, but not a rear wall or top.

FIG. 11 illustrates a perspective detail view of a portion of a gang-lock system for a cabinet in accordance with aspects of the invention. A mechanical lock 110, which includes an arm 111 has been activated, and the arm rotated to engage a platform 176. The platform is connected to the serpentine rod 123 near an end of the serpentine rod. The arm, in engaging the platform, raises the serpentine rod, and places the system in an unlocked position.

Figure 12:
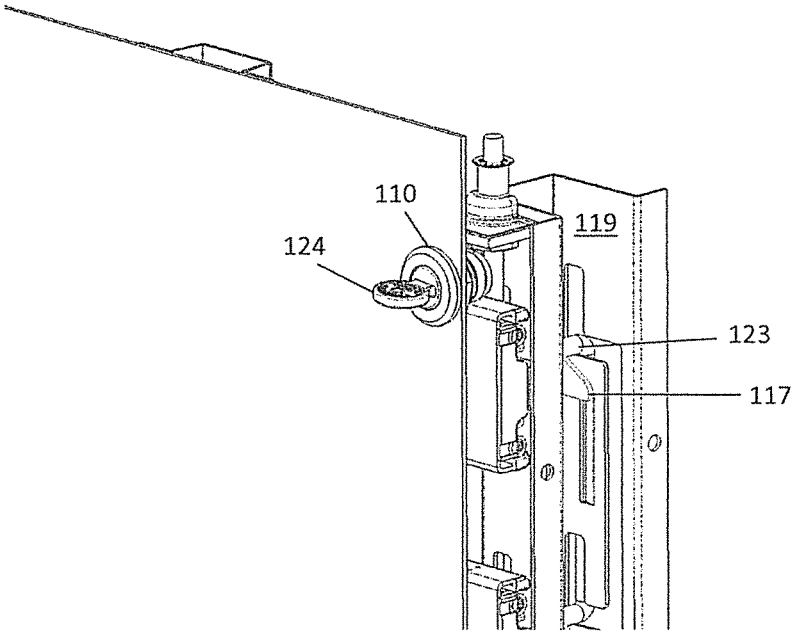
FIG. 12 illustrates the device of FIG. 11, from a viewpoint outside of the cabinet structure.

FIG. 12 illustrates a perspective detail view of the portion of the gang-lock system for a cabinet from the opposite perspective of that in FIG. 11 in accordance with aspects of the invention. A key 124 is turned in the mechanical lock 110, placing the mechanical lock in a locked position. The serpentine rod 123 has lowered under the force of gravity, coming to rest against the channel 119, and engaging the bracket 117.

Figure 13:
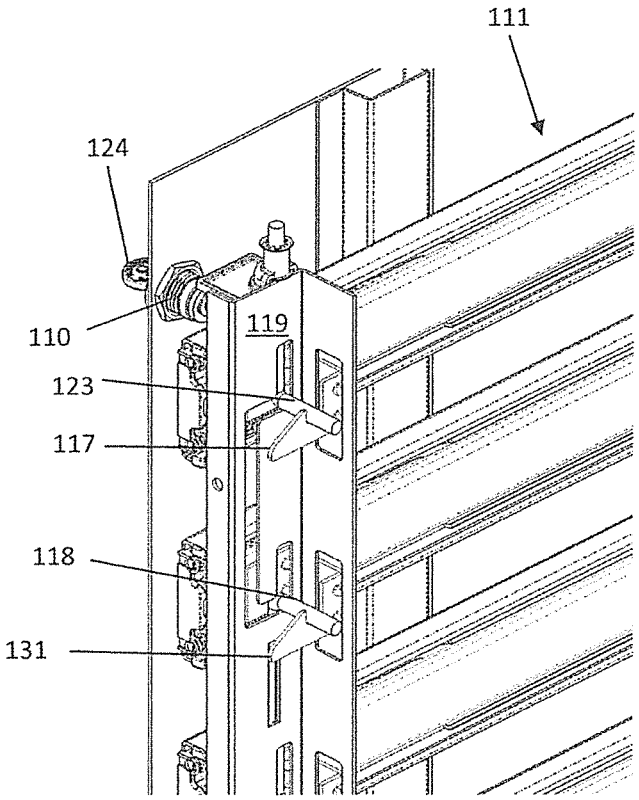
FIG. 13 shows the gang lock mechanism with an optional cam key lock of FIG. 11 for mechanical activation in the event of a power loss, with the rod in the locked position. This is an alternate sectioned view of the inside cabinet structure and channel to show rod engagement to the drawer member hook. The hook is provided with an angled profile that will allow the slide to lift the serpentine rod if the system is locked with a drawer still open. Once the rod moves past the upper portion of the angled hook it drops into the cavity and is secure until the rod is lifted by the electronic lock or the manual key override.

FIG. 13 illustrates a perspective detail view of the portion of the gang-lock system for a cabinet shown in FIG. 12 in accordance with aspects of the invention. A key 124 is turned in the mechanical lock 110, placing the mechanical lock in a locked position. The serpentine rod 123 has lowered under the force of gravity, coming to rest against the channel 119, and engaging the bracket 117. The triangular hook portion 131 of the bracket 117 retains the serpentine rod in the rectangular cut out 118 of the bracket. This locked position prevents the drawer slide 111 from moving.

Figure 14:
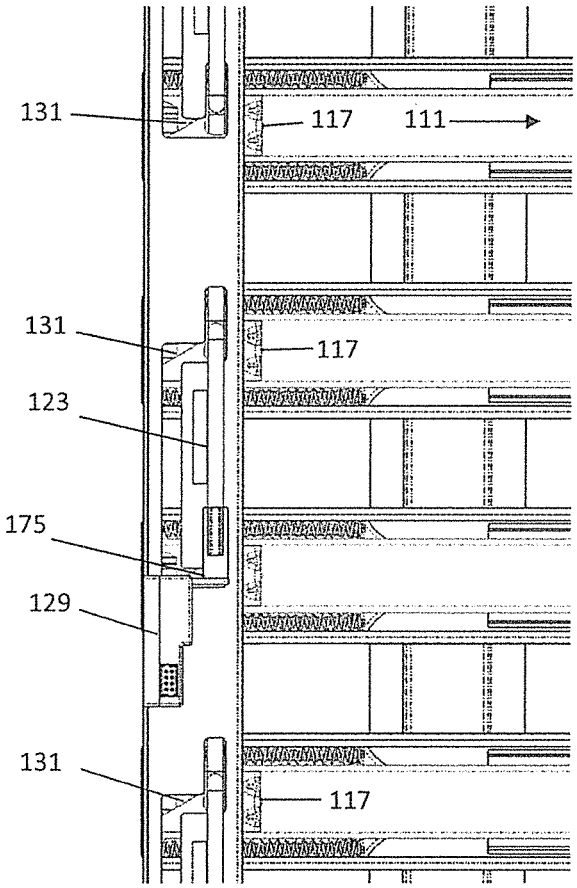
FIG. 14 is a side view of portions of the gang lock device of FIG. 1, with the gang lock mechanism in the up and unlocked position.

FIG. 14 illustrates a side view of a portion of the gang-lock system for a cabinet in accordance with aspects of the invention. The motor unit 129 has been activated, rotating the cam arm (not shown) and lifting the platform 175. The serpentine rod 123 is lifted through the channel engagement to the platform to an unlocked position clear of the top of the triangular hook portion 131 of the bracket 117. From this position, the drawer slide 111 may move longitudinally in the direction shown by the arrow.

Figure 15:
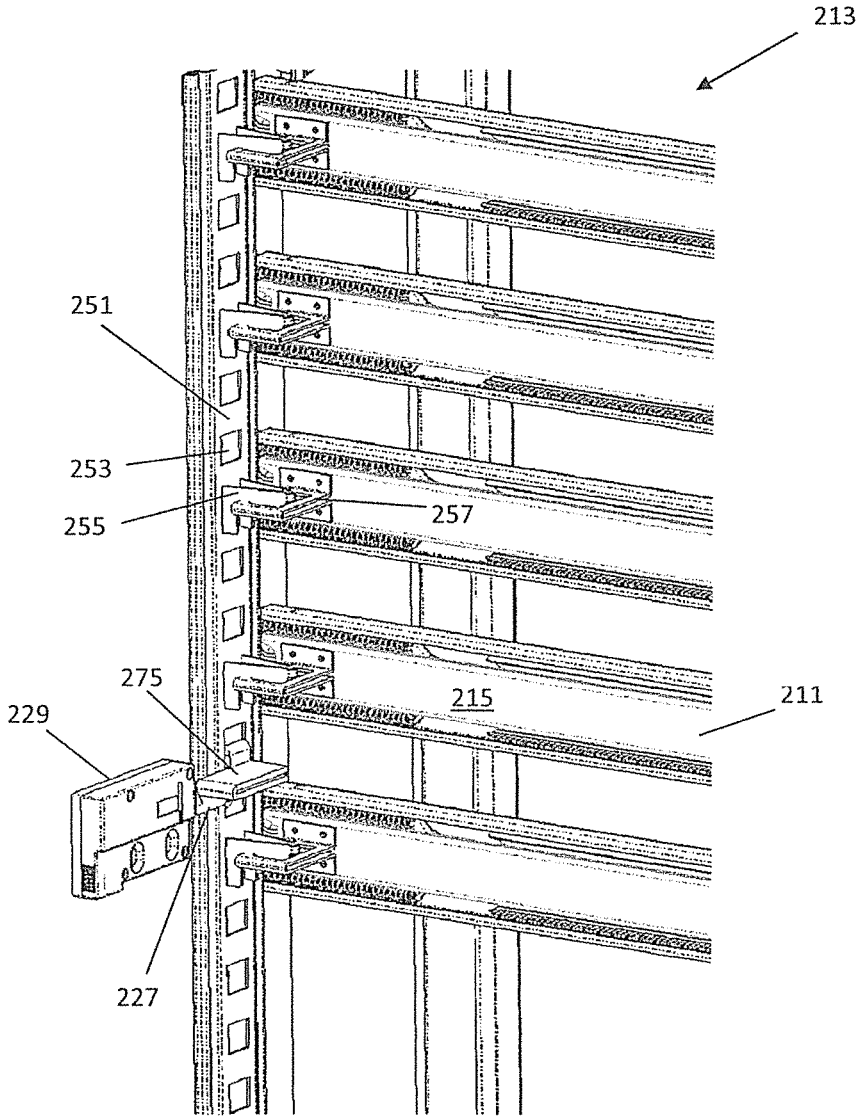
FIG. 15 is an isometric view of a further gang lock device in accordance with aspects of the invention, with the gang lock mechanism in the down and locked position. The mechanism is mounted at the rear of the cabinet. Fixed brackets are attached to the slide and engage with a hook located on a movable track within a channel. The channel is fixed in position. A lock cam arm is powered by a motor, and when rotated vertically displaces, or lifts an interconnecting platform attached to the movable track. As the hooks are attached to the movable track, the hooks are lifted also, with the hooks clearing the brackets attached to the slides. This design also allows for the use of multiple slide cross-sections with multiple performance features.

FIG. 15 shows a perspective view of a portion of a gang-lock system for a cabinet in accordance with aspects of the invention. In FIG. 15, an exemplary drawer slide 211, is mounted to a side wall of a cabinet 213 or some other enclosure. Drawers (not shown) are generally mounted to an inner slide member, for example, inner slide member 215, where the inner slide member is at least partially extendable from the cabinet, in order to allow access to the content of the drawer. As illustrated in FIG. 1, the drawer slide is a telescopic drawer slide, with an outer slide member having a longitudinal web engaged along both longitudinal edges by raceway channels, which contain a similar intermediate slide member, which contains a similar inner slide member. In various embodiments, other drawer slides, for example, over-and-under drawer slides, may be used instead.

Locking rings 257 are mounted to the inner slide member 215. Locking rings 257 may be mounted by various means to the inner slide member 215, including by way of various connectors, adhesives, welding, rivets, or threaded fasteners. Locking rings 257 have an aperture sized and shaped to contain a locking hook 255. The aperture is sized so as to allow for some variation in alignment in the transverse direction of the inner slide member. The locking hook 255 is shaped so that the end of the hook portion engages with the aperture of the locking ring 257 and the hook eye is sized and shaped to engage a section of the interior circumference of the aperture and a section of the exterior perimeter of the locking ring such that the engagement prevents any forward motion of the drawer in a longitudinal direction.

The base portion of the hook engages a bracket 251. The bracket 251 is mounted within a fixed channel that allows for vertical movement of the bracket 251. The fixed channel is mounted to the rear of a first end of the inner slide member, and may be attached to an internal surface about the rear panel of the cabinet. In various embodiments, the fixed channel is attached to an interior surface of rear panel of the cabinet, or a frame for the rear panel, or in some cases an interior surface of a side panel of the cabinet. The locking hooks 255 may be attached to any of a plurality of mounting points 253 on the bracket, in order to achieve proper alignment with the locking rings 257. In addition, the plurality of mounting points allow the system to accommodate various drawer configurations, in vertical size and/or placement. The base of the locking hooks 255 comprises two flanges. These flanges extend laterally from the two sections of the V shaped legs of the mounting hooks shown in FIG. 15. When a force is applied to the two legs such that it closes the open end of the V, and brings the two flanges closer, the flanges may pass through the opening the mounting point. When the force is released, the legs bias outward and the flanges engage the bracket 251. The flanges are sized and shaped to prevent any vertical movement of the locking hook 255 within the mounting point. The bracket 251 and locking hooks 255 can be comprised of a lightweight material that will maintain strength, for example various alloys, or a reinforced polymer.

Vertical movement for the bracket 251 is provided by a platform 275, which engages with a mounting point on the bracket 251 in a manner similar to that of the locking hooks 255. A cam arm 227, driven by a motor unit 229, is under the platform. Operation of the motor may lower the cam arm 227, allowing the bracket to move downward under the force of gravity, engaging the locking hooks 255 with the locking rings 257, locking the drawers as shown in FIG. 15. When the cam arm 227 moves upward, it drives the platform 275 and the attached bracket 251 upward, disengaging the locking hooks 255 from the locking rings 257, thereby unlocking the drawers.

Figure 16:
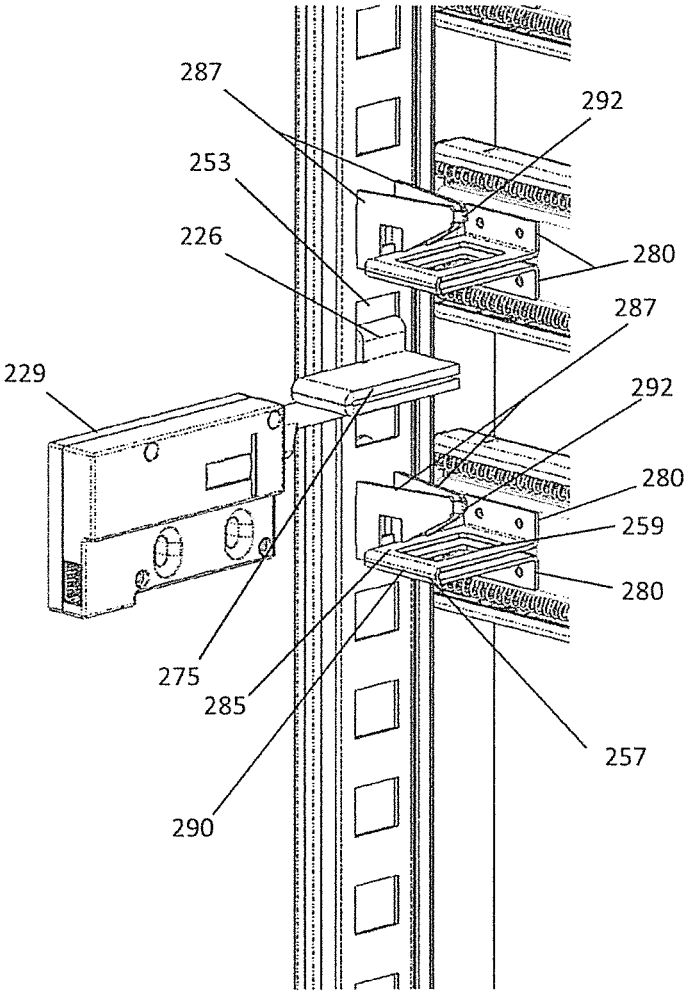
FIG. 16 shows a close up isometric view of portions of the device of FIG. 15, with the gang lock mechanism.

FIG. 16 shows a perspective detail view of a portion of a gang-lock system for the cabinet shown in FIG. 15 in accordance with aspects of the invention. The system is shown in the unlocked position. The motor unit 229 has rotated cam arm 227 upward, which has, in turn, driven the platform 275 upward. The locking hooks 255 have disengaged from the locking rings 257, leaving the aperture 259 of the locking ring 257 open. The locking rings 257 may be, and as shown in FIG. 16, formed of a single bent piece of material. This allows for flanges to be formed for mounting to the inner slide member 215 by bending the ends of the piece of material to form flanges. In addition, it lends additional strength to the locking ring by doubling the thickness of the ring body 285. The aperture 259 is formed by two cut outs in the single bent piece which align when the piece is doubled over on itself by a bend near the middle 290. The platform 275 is engaged to the bracket by mounting flanges 226 extending from the upper side and lower side (not shown) of the platform 275. The flange 226 on the upper side is bent in a U-shape with the opening (not shown) facing downward when the flange 226 is hooked into the interior of the mounting point 253. The platform 275 is formed, in some embodiments, by bending and cutting a single piece of material.

The locking hook legs are each attached at their apex to one of the legs of a small leaf spring 292. The leaf spring 292 biases the locking ring panels 287 outward so that the flanges (not shown) at the base of the locking ring panels engage with the mounting point 253.

Figure 17:
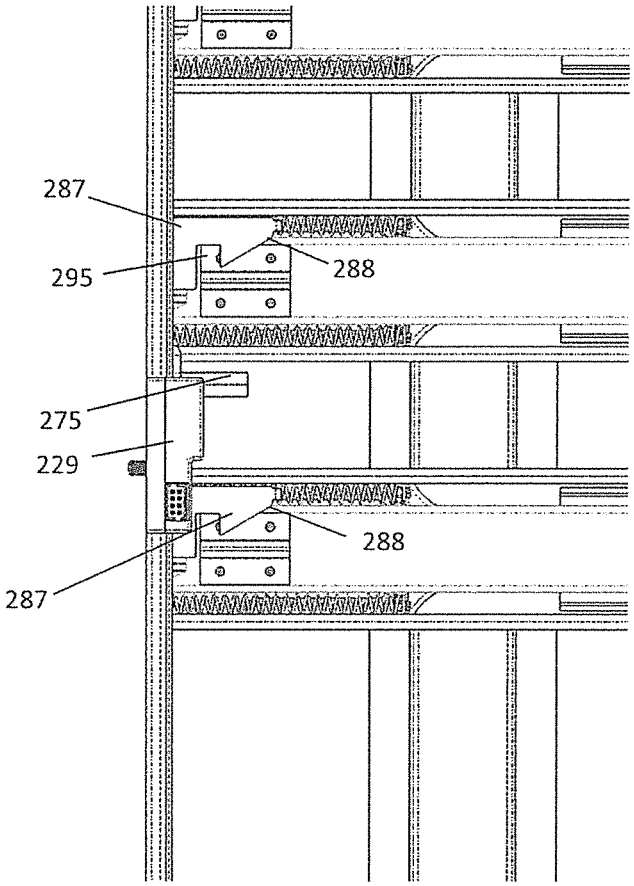
FIG. 17 a side view of the gang lock device of FIG. 15 with the mechanism in the unlocked position. The track hooks incorporate an angled contour that allows for the fixed slide bracket to lift the track hooks in the event the system is in the locked position with a drawer in the open position. The fixed bracket will, as the slide member retracts with closing of the drawer, cause the hooks to ramp up the angled contour, with the hooks dropping into the locked position once past the edges of the opening in the fixed bracket.

FIG. 17 shows a side view of the portion of a gang-lock system for a cabinet shown in FIG. 16. The system is in the unlocked position, with the hooks clear of the locking rings, and the platform 275 is in a raised position relative to the motor unit 229. The locking hooks have panel legs 287 having a generally triangle profile with a downward facing rectangular cut out. The rectangular cut out is sized, shaped and positioned to allow the opening of the locking hook eye 295 to protrude into and below the aperture 259 and the exterior perimeter of the locking hook 255. The panel legs 287 of the locking hooks 255 have an angled leading edge 288, with the angled leading edge positioned, when in the locked position, so as to be in a travel path of the locking ring 257 during rearward movement of the drawer (not shown). The angled leading edge 288 causes the individual locking hook 255 and the connected bracket 251 to lift and then return to the locked position, which is useful in the event it is desired to close a drawer when the system is locked with the drawer in the open position.

Figure 18:
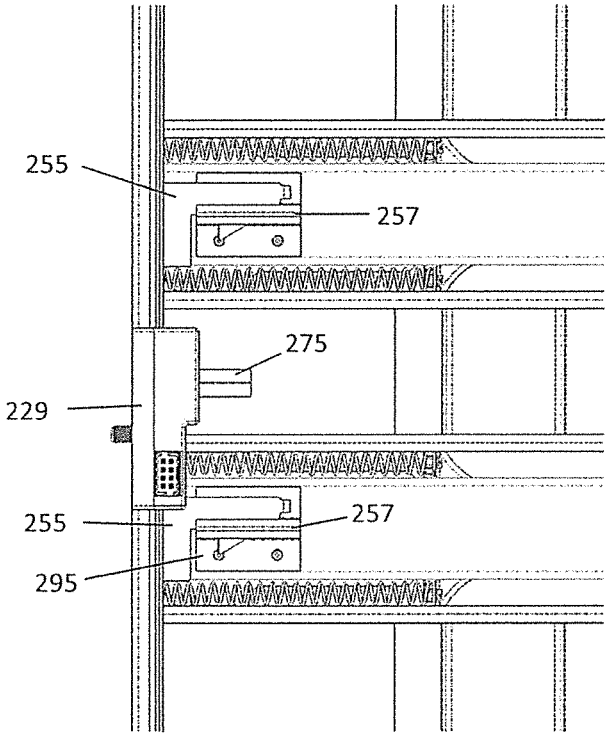
FIG. 18 a side view of the gang lock device of FIG. 15 with the mechanism in the locked position.

FIG. 18 shows a side view of a portion of the gang-lock system of FIG. 17. In FIG. 18, the system is in the locked position. The platform 275 is in a lowered position relative to the motor unit 229. The locking hook eye 295 protrudes through and below the aperture of the locking ring 257.

Figure 19:
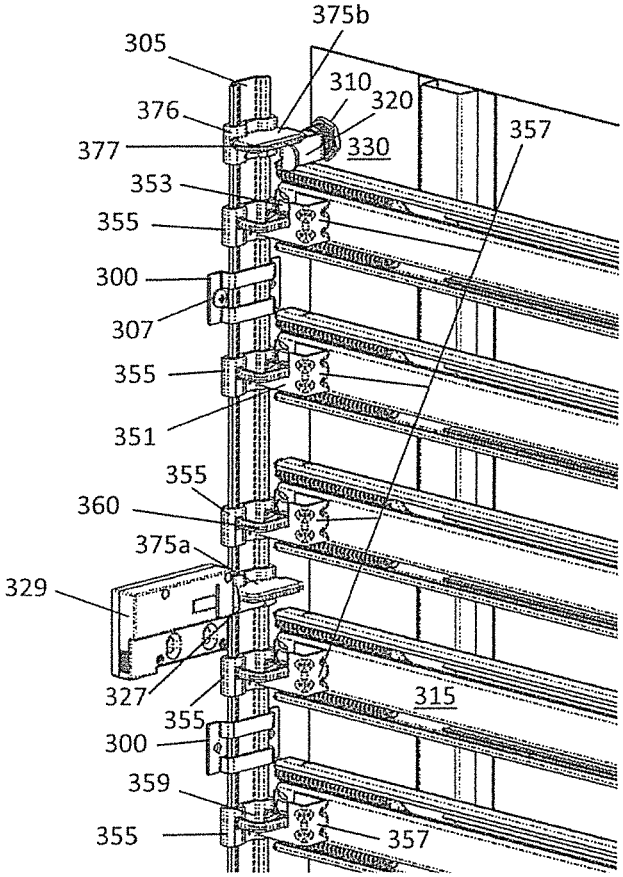
FIG. 19 is an isometric view of yet a further gang lock device in accordance with aspects of the invention, with the gang lock mechanism in the down and locked position. The mechanism is mounted at the rear of the slides. A cam arm, powered by a motor unit, is located under a lift platform, which is attached to a slideable or vertically moveable track. A bracket hook is fixedly attached to the slides, with the hooks insertable into loops infinitely adjustable along the track. The lifting platform is also infinitely adjustable along the track. The sliding track is supported by smaller adjustably located fixed brackets, mounted for example to a rear wall of the cabinet. The figure also shows a mechanical lock engagement that uses a similar lifting platform, shown about the top of the track.

FIG. 19 shows a perspective view of a portion of a further gang-lock system for a cabinet, in accordance with aspects of the invention. The embodiment of FIG. 19 includes a plurality of mounting brackets 300 positioned at points along a mounting track 305. The mounting brackets 300 are attached in one embodiment by a plurality of connectors 307. In other embodiments they are attached by adhesives. The mounting track 305 passes through the mounting brackets 300, and is used to mount the locking rings 355. The mounting track 305 can mount a plurality of locking rings 355 at any point along the mounting track's 305 length. The locking rings 355 are placed along the track at locations corresponding to the location of locking hooks 357 mounted to the inner slide members 315.

The mounting track 305 is formed from a single strip of material and formed into a modified U cross section. Flanges extend outward from the ends of the side walls of the U, and are generally parallel to the bottom of the U. For the locking rings, a locking ring base 359 is formed of a single piece, and is sized and shaped to fit the inward face of the cross section of the mounting track 305, and to have portions that are bent so as to hook around the side edges of the face of the mounting track 305 and terminate in the space between the inner surface of the cabinet panel (not shown) and the mounting track 305. The locking rings 355 may be mounted to the mounting track 305 by sliding the locking ring base 359 over one of the ends of the track and then along the track to the appropriate location. The locking rings may be held in position, for example, through use of set screws passing through the locking ring base. A ring portion 360 of the locking ring is formed from a single piece of U shaped bent material that is symmetrical about its longitudinal axis and attached to the locking ring base 359. In some embodiments the ring portion is welded to the locking ring base 359, in other embodiments the locking ring base and ring may be integrally formed.

The locking hooks 357 are mounted to the inner slide members 315 of the drawer slides. The locking hooks 357 may be formed from a modified u-shaped bracket. A leg of the bracket 351 opposite that mounted to the inner slide member form a triangular hook shape. In this embodiment, the locking hooks 357 are oriented with the rectangular cut out hook eye 353 facing upward, and engage the locking rings 355 when the locking rings 355 move downward under the force of gravity. In some embodiments the locking hooks are mounted to the inner slide member with connectors. In other embodiments the locking hooks are mounting to the inner slide member with adhesives.

A platform member 375*a* has a base 376 similar to the base of the locking rings 359 and engages similarly with the mounting track 305. A flat piece 377 of the platform engages the cam arm 327 is formed of a rectangular piece of material. One edge is engaged to the platform base 376. An electric motor unit 329 has a cam arm 327 that engages the platform 375 to drive the platform 375 upward into an unlocked position. When the cam arm 327 rotates into a lower position, the mounting track 305 and attached platform 375 and locking rings 357 move downward under the force of gravity to a locked position.

A second platform 375*b* is engaged by a mechanical lock 310 mounted to the inner surface of the cabinet side panel 320 above the top most drawer slide. The mechanical lock 310 comprises an arm 320 rotated by a rotor structure (not shown). The rotor structure is activated by the rotation of a key (not shown) inserted in the key aperture of the rotor (not shown). The mechanical lock 310 is in the locked position. When the mechanical lock 310 is in the locked position, the motor unit 329 alone controls the locking and unlocking of the system. When the mechanical lock 310 is in the unlocked position, the system will remain unlocked, regardless of the operation of the motor unit 329 and cam arm 327. Here, the motor unit 329 has lowered the cam arm 327, placing the system in a locked position.

Figure 20:
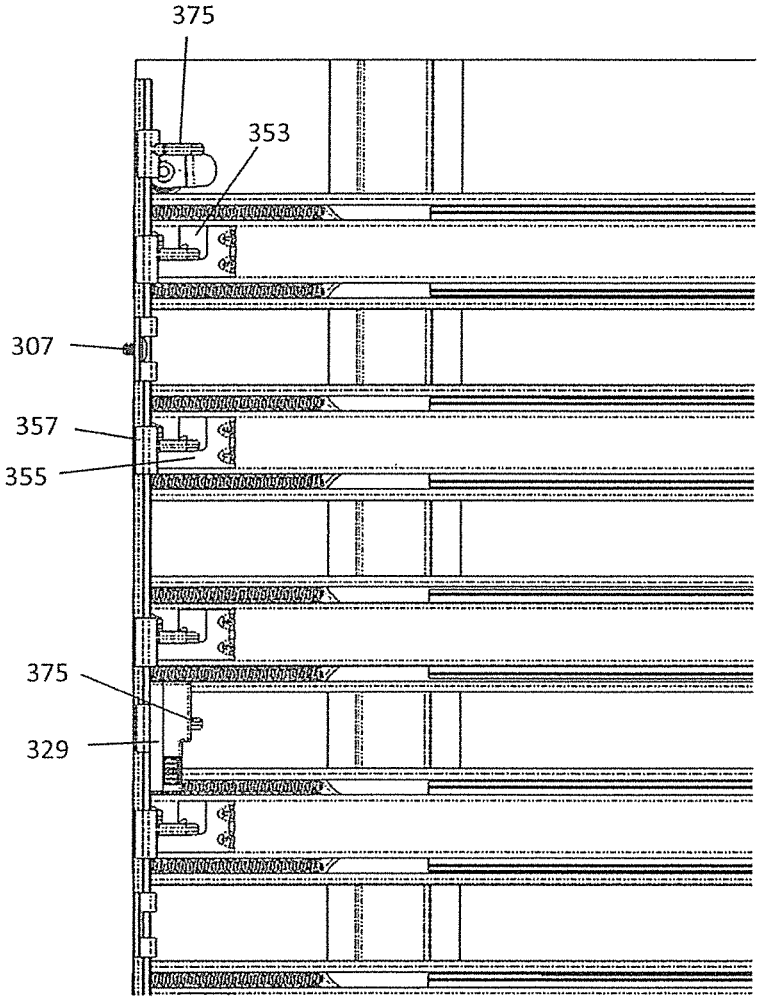
FIG. 20 is a side view of the gang lock device of FIG. 19 in the locked position.

FIG. 20 shows a side view of a portion of the gang-lock system for a cabinet shown in FIG. 19. Both ends of the locking hook eye 353 protrude above the locking ring. The mounting bracket connector 307 extends into the panel of the cabinet. The platform 375*a* is in a relatively low position with regard to the motor unit 329. The mechanical lock 310 is in the locked position with the mechanical lock arm 320 rotated away from the corresponding platform 375*b*. The system is in a locked position with the locking rings 357 engaging the locking hooks 355.

Figure 21:
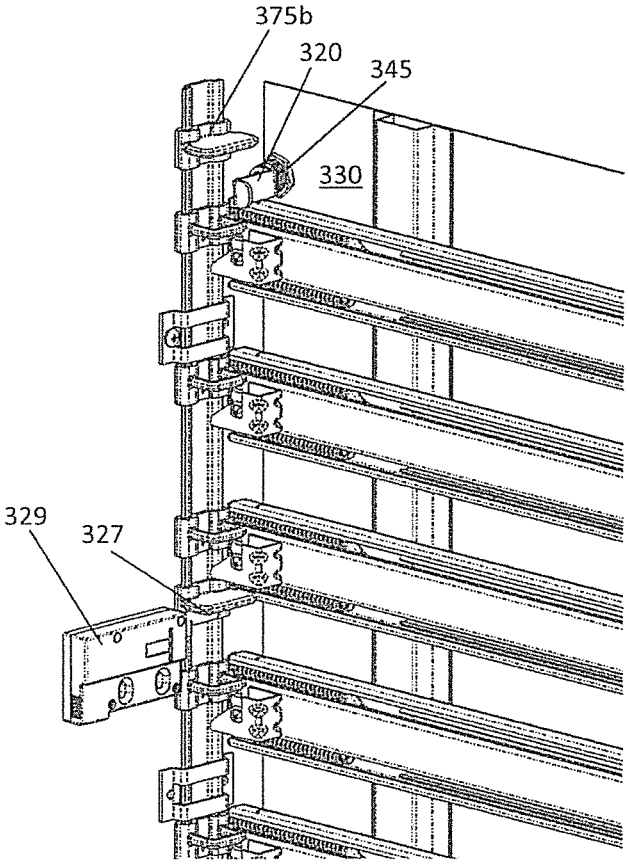
FIG. 21 is an isometric view of the gang lock device of FIG. 19 with the gang lock mechanism in the up and unlocked position.

FIG. 21 shows a perspective view of the portion of a gang-lock system for a cabinet shown in FIG. 19. At the top of the mounting track is mounted the second platform 375*b*. The platform 375*b* is engaged by the mechanical lock 310 mounted to the inner surface of the cabinet side panel 330 above the top most drawer slide. The mechanical lock 310 comprises the arm 320 rotatable by a rotor structure 345. The rotor structure 345 is activated by rotation of a key (not shown) inserted in the key aperture of the rotor (not shown). The mechanical lock 310 is in the locked position. When the mechanical lock 310 is in the locked position, the motor unit 329 alone controls the locking and unlocking of the system. When the mechanical lock 310 is in the unlocked position, the system will remain unlocked, regardless of the operation of the motor unit 329 and cam arm 327. Here, the motor unit 329 has raised the cam arm 327, placing the system in an unlocked position.

Figure 22:
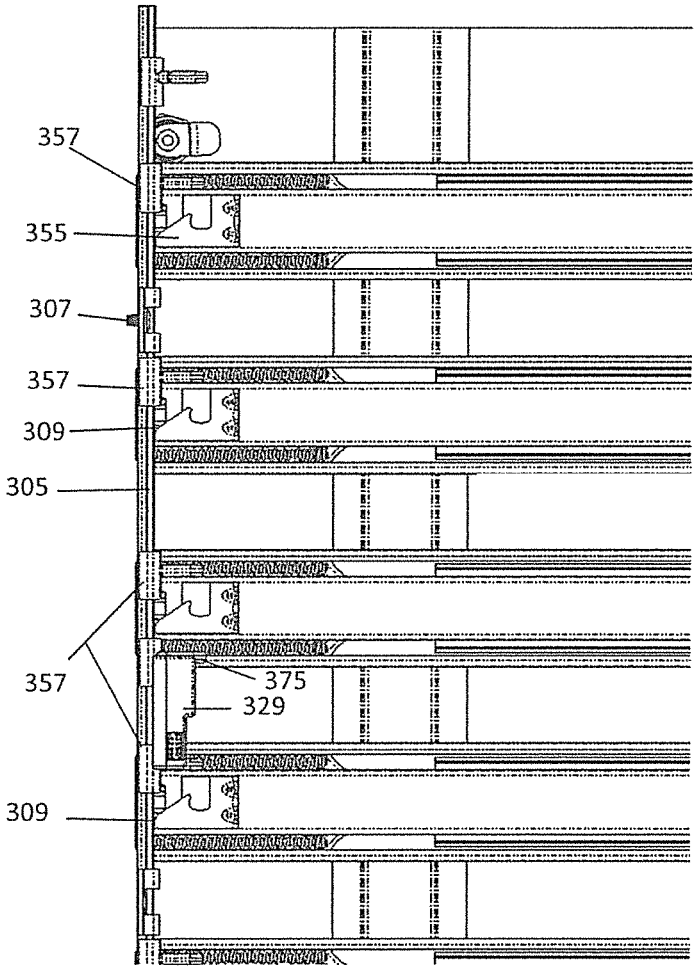
FIG. 22 is a side view of the gang lock device of FIG. 19 in the up and unlocked position.

FIG. 22 shows a side view of a portion of the gang-lock system for a cabinet shown in FIG. 21 in accordance with aspects of the invention. The triangle with rectangular cut out shape of the locking hooks 355 is visible, as the mounting track 305 and mounted locking rings 357 have been raised by the cam arm (not shown) connected to the motor unit 329 driving the platform 375 into a relatively high position, placing the system into an unlocked position. A connector 307 of the mounting bracket 300 is shown connected to a panel of the cabinet. The leading edge 309 of the triangle goes from lower to higher starting from the edge closest to the end of the drawer slide nearest the rear of the cabinet.

Figure 23:
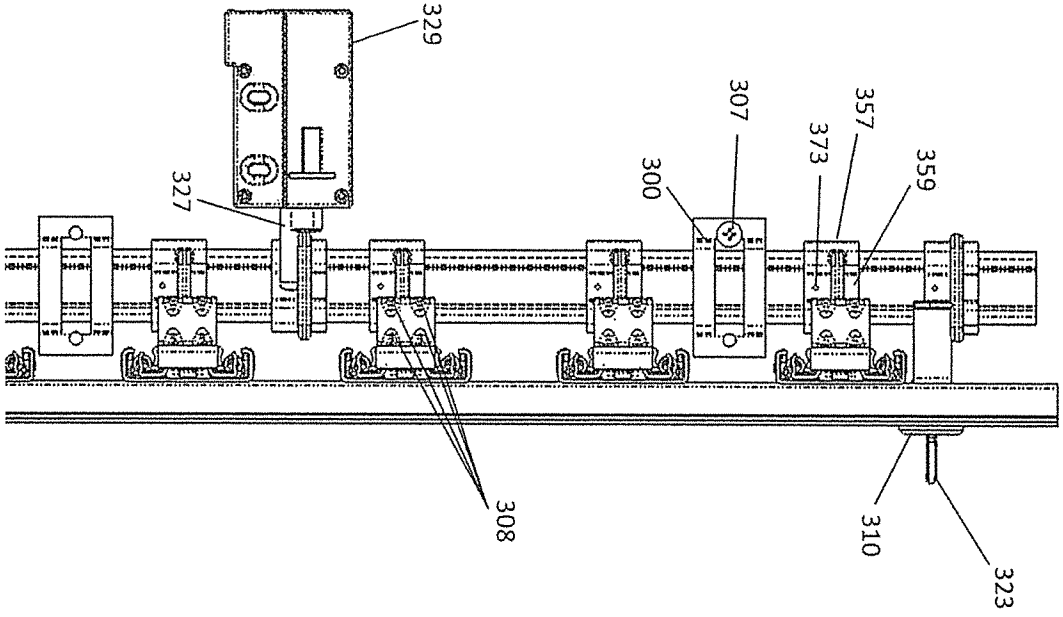
FIG. 23 is a front view of the gang lock device of FIG. 19 with the gang lock mechanism in the down and locked position.

FIG. 23 shows a front view of a portion of a gang-lock system for a cabinet shown in FIG. 21 in accordance with aspects of the invention. A key 323 is inserted in the rotor (not shown) of the mechanical lock 310. In some embodiments the locking rings 357 have a set screw 373 in the base 359 to prevent their sliding along the mounting track 305 once properly positioned. In other embodiments, the locking ring base 359 has a dimple to provide for a friction fit between the base and the mounting track 305. The connectors 307 connect the mounting bracket 300 to a panel of the cabinet (not shown). Also shown are the gussets 308 formed along the corner edges of the locking hooks 355 to add strength to the locking hook 355. The motor unit 329 has lowered the cam arm 327, and the mounting track 305, under force of gravity, has moved vertically into a locked position.

Figure 24:
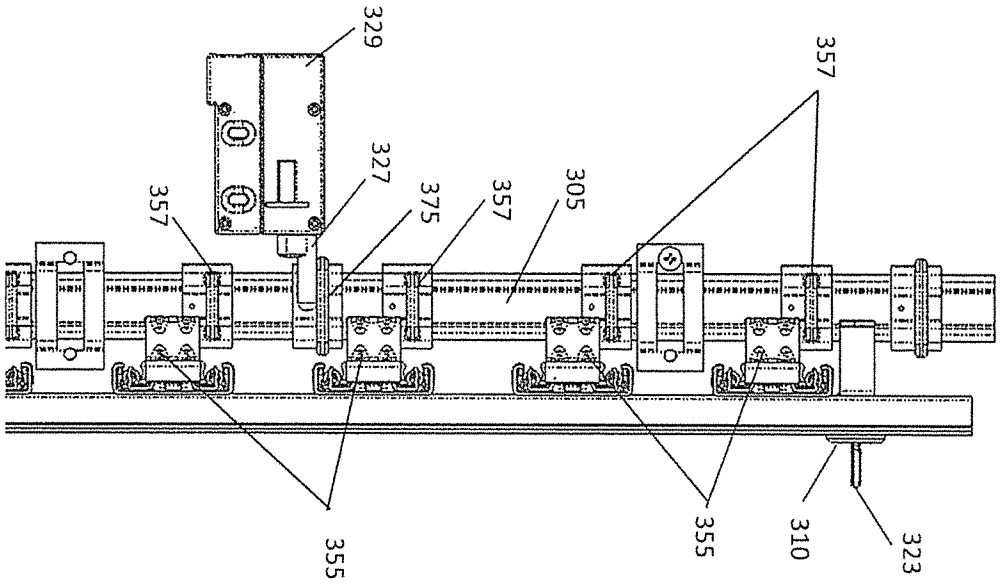
FIG. 24 is a front view of the gang lock device of FIG. 19 with the gang lock mechanism in the up and unlocked position.

FIG. 24 shows a front view of a portion of the gang-lock system for a cabinet shown in FIG. 21. A key 323 is inserted in the rotor (not shown) of the mechanical lock 310. The mechanical lock 310 is in the locked position. The motor unit 329 has raised the cam arm 327, thereby driving the platform 275 in contact with the mounting track 305 upward, and placing the system in an unlocked position. The locking rings 357 are visible above the locking hooks 355.

Figure 25:
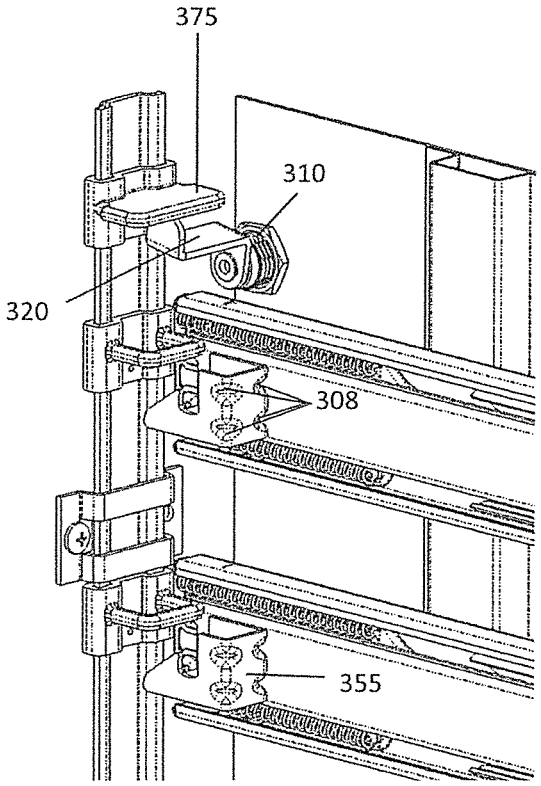
FIG. 25 is a close up view of a mechanical lock biasing the gang lock device of FIG. 19 into the unlocked position by lifting of the upper lifting platform. The track loops are fully disengaged from the hooks on the slide members. The track loops and the lifting platform are movable along the lifting track to align with the location of the slide hooks for proper engagement. The track loops and track platform are fixed into location by a set screw or other similar means. The track, track loops and track platform can be comprised of metal or, in some embodiments, a reinforced polymer to conserve weight but maintain strength.

FIG. 25 shows a perspective view of a portion of the gang-lock system for a cabinet shown in FIG. 21. The mechanical lock 310 has been activated and the arm 320 of the mechanical lock 310 rotated into contact with the corresponding platform 275 to place the mechanical lock 310 in the unlocked position. The motor unit's (not shown) cam arm (not shown) will have no effect on the locking of the system with the mechanical lock 310 in the unlocked position. Shown in detail are the locking hooks 355 that have a plurality of gussets 308 formed on the corner edges for added strength.

Figure 26:
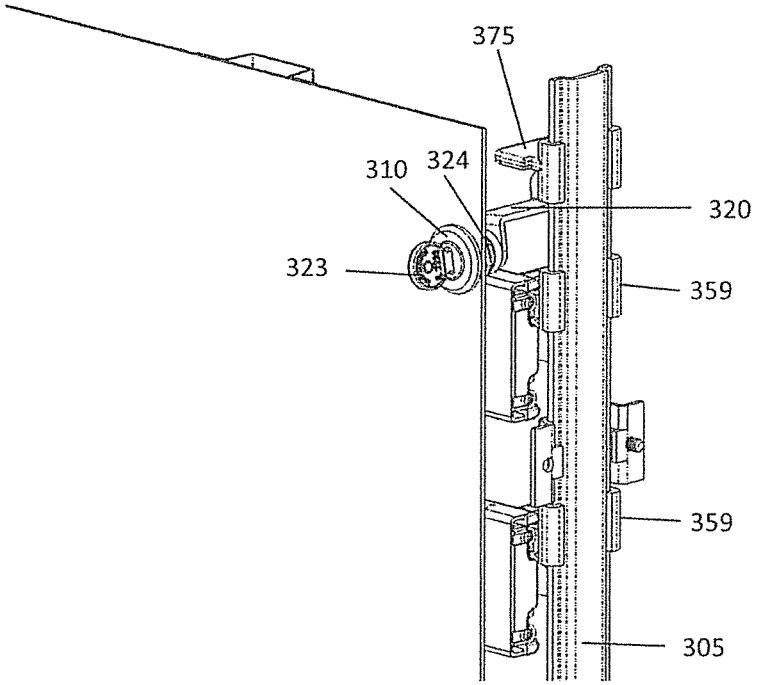
FIG. 26 is a further close up view of the mechanical lock biasing the gang lock device of FIG. 19, with an optional cam key lock for mechanical activation in the event of a power loss. The mechanical cam key lock vertically displaces the track independent of the electronic gang lock.

FIG. 26 shows a perspective view directly opposite that shown in FIG. 25 of a portion of the gang-lock system. The termination of the locking ring bases 359 is clearly shown. The locking ring bases 359 wrap around the edges of the mounting track 305, and then terminate behind the mounting track 305 in the space between the mounting track 305 and the interior surface of the cabinet panel (not shown). The mechanical lock 310 has been activated, the key 323 rotating the rotor 324 and arm 320 to an unlocked position. The arm 320 of the mechanical lock 310 has engaged the corresponding platform 275, moving the mounting track 305 vertically and disengaging the locking rings (not shown) from the locking hooks (not shown), placing the system in an unlocked condition.

Figure 27:
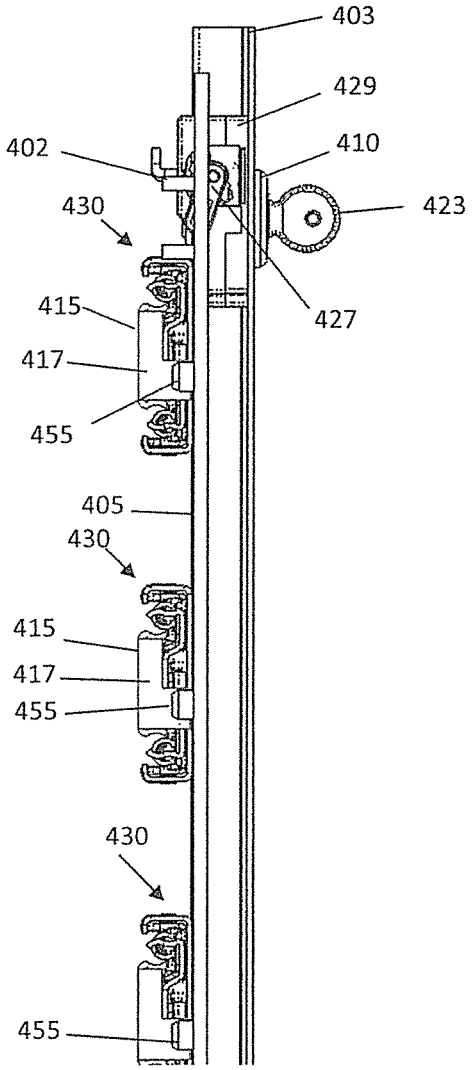
FIG. 27 is a front view of a gang lock device with a vertical bar and fixed pins located about a front of a cabinet, with the pins blocking an inner slide member from opening by interfering with an integrated formed or fabricated tab on the slide member. The locking bar is shown in the locked position.

FIG. 27 shows a front view of a portion of a gang-lock system for a cabinet in accordance with aspects of the invention. In some embodiments, the motor unit 429 and mechanical lock 410 may be integrated, so that they both control the same cam arm 427. A key 423 is inserted in the mechanical lock 410. The assembly is mounted on the interior of a cabinet side panel 403 near the drawer faces (not shown). When activated by the motor unit 429, or in some embodiments the key 423, the cam arm 427 passes through an aperture (not shown) in a locking bar 405, and engages the edge of the aperture (not shown) as well as an integrally formed flange 402, lifting the locking bar 405 vertically along the interior of a cabinet side panel 403. Bosses 455 are spaced along the locking bar 405 to align with the end 417 of the inner member of the slide 415. In one embodiment, the bosses 455 are attached to the locking bar 405 with connectors. In other embodiments, the locking bar 405 and bosses 455 are integrally formed. Any lightweight but strong material may be used to form the locking bar 405 and bosses 455, for example, metal alloys and reinforced polymer. When the cam arm 427 is lowered, the bosses 455 prevent the inner member of the slide 415 from moving longitudinally, placing the system in a locked position. When the cam arm 427 lifts the locking arm 405, the bosses 455 are moved clear of the end 417 inner member of the slide 415, and the drawer slide 430 is free to move longitudinally, placing the system in an unlocked position. As shown in FIG. 27, the cam arm 427 is down, and the system is in a locked position.

Figure 28:
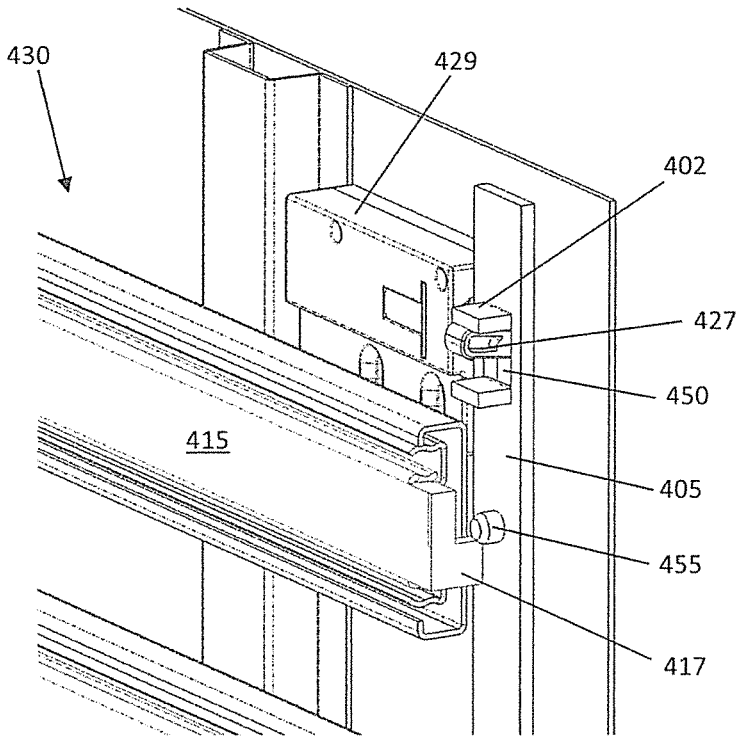
FIG. 28 is an isometric view of the gang lock device of FIG. 27 with a cam arm driving the locking bar into the unlocked position.

FIG. 28 shows a perspective view of a portion of a gang-lock system for a cabinet shown in FIG. 27 in accordance with aspects of the invention. The motor unit 429 has moved the cam arm 427 through the aperture 450 and engaged the integral flange 402 in lifting the locking arm 405. The bosses 455 are clear of the end 417 inner member of the slide 415, and the drawer slide 430 is free to move longitudinally, placing the system in an unlocked position.

Figure 29:
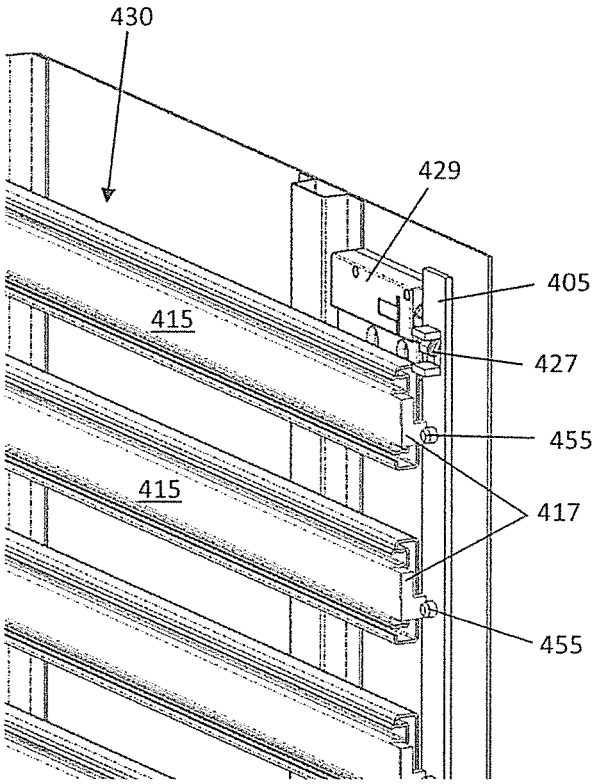
FIG. 29 is an isometric view of the gang lock device of FIG. 27 with the vertical bar shown in the locked position.

FIG. 29 shows a perspective view of a portion of a gang-lock system for a cabinet shown in FIG. 27 in accordance with aspects of the invention. Here, the motor unit 429 has lowered the cam arm 427, moving it back through the aperture 450 in turn lowering the locking arm 405, the bosses 455 have moved into a position blocking the end 417 of the inner member of the slide 415, and the drawer slide 430 is not able to move longitudinally, placing the system in a locked position.

Figure 30:
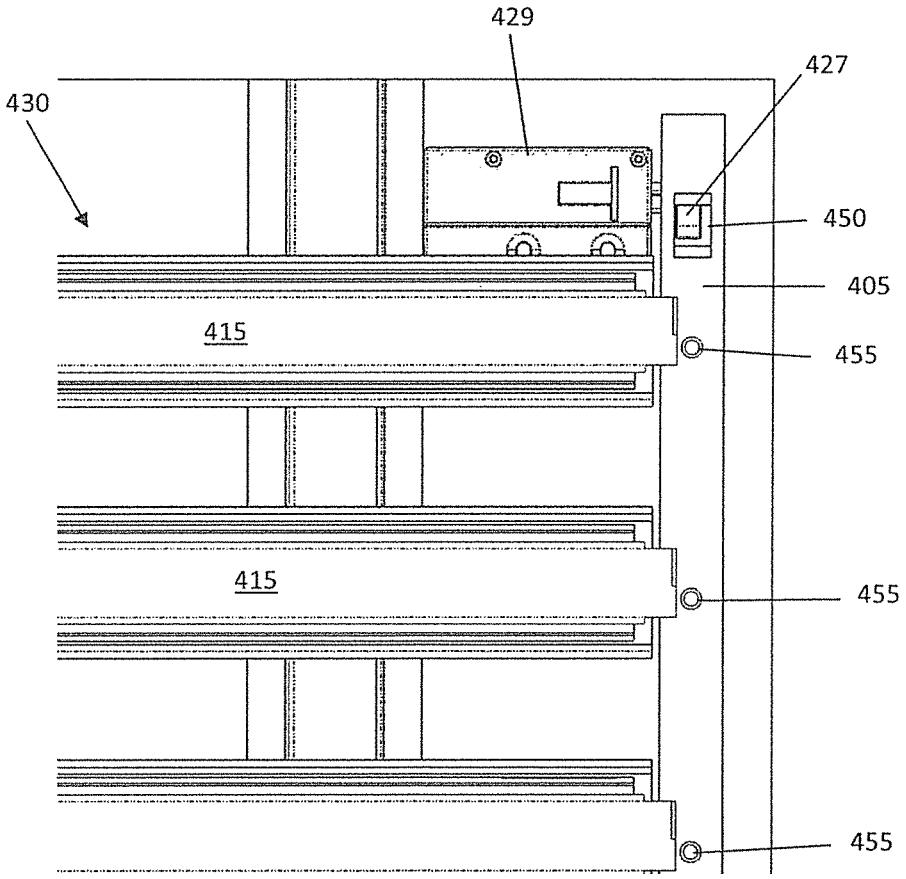
FIG. 30 is a side view of the gang lock device of FIG. 27 with the vertical bar shown in the locked position.

FIG. 30 shows a side view of a portion of a gang-lock system for a cabinet shown in FIG. 29 in accordance with aspects of the invention. Here, the motor unit 429 has lowered the cam arm 427 in turn lowering the locking arm 405, the bosses 455 have moved into a position blocking the end 417 of the inner member of the slide 415, and the drawer slide 430 is not able to move longitudinally, placing the system in a locked position.

Figure 31:
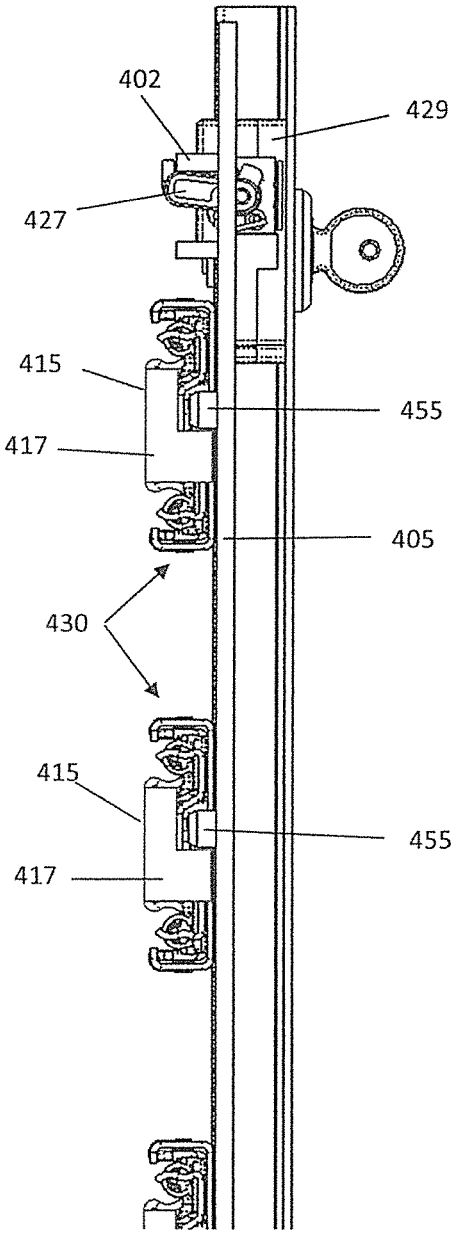
FIG. 31 is a front view of the gang lock device of FIG. 27 with the vertical bar in the unlocked position.

FIG. 31 shows a front view of a portion of a gang-lock system for a cabinet in accordance with aspects of the invention. The motor unit 429 has moved the cam arm 427 through the aperture (not shown) and engaged the integral flange 402 in lifting the locking arm 405. The bosses 455 are clear of the end 417 inner member of the slide 415, and the drawer slide 430 is free to move longitudinally, placing the system in an unlocked position.

Figure 32:
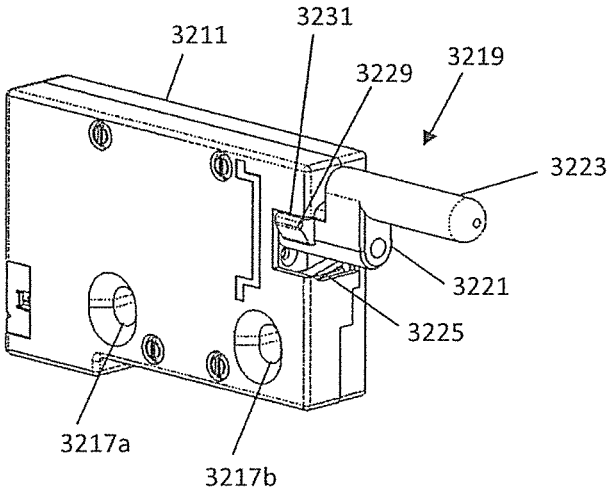
FIG. 32 is an isometric view of a further motor unit in accordance with aspects of the invention.

FIG. 32 illustrates a further motor unit in accordance with aspects of the invention. The motor unit includes a casing 3211 with a frontal opening 3225. A rotatable cam arm 3219 extends forward from the frontal opening. The cam arm includes a cam portion 3221 and an arm portion 3223 extending forward from a protruding end of the cam portion. As illustrated in FIG. 32, the arm portion is in a fully raised position, with a cam stop 3229 integral to the cam arm engaged with a base of the casing, or in some embodiments a cutout portion 3231 of the casing, to prevent over rotation of the cam arm when moving to the fully raised position.

The casing includes two mounting apertures 3217*a,b* for use in mounting the motor unit, for example to a cabinet side wall. As may be more clearly seen in FIG. 33, the mounting apertures are slightly oblong, to allow for adjustment of position of the motor unit during mounting.

Figure 33:
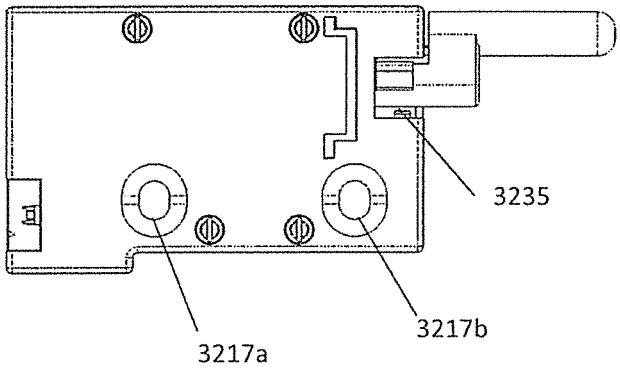
FIG. 33 is a side view of the motor unit of FIG. 32, showing vertical mounting slots for attaching the motor unit to a cabinet wall or other supporting structures within the cabinet. Slots allow for vertical adjustment to ensure complete release and/or engagement of the motor unit.
Figure 34:
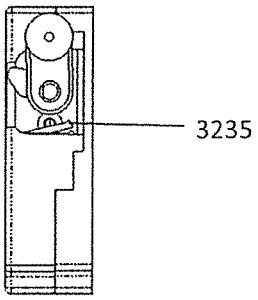
FIG. 34 is a front view of the motor unit of FIG. 32 with the rotating cam arm in the highest position. Features integral to the rotating cam arm provide a contact pad to engage with the contact switches. The flat profile allow for a smaller gear motor for limited load capacity. The thinner section (compared to the motor unit of FIG. 6) fits, in some embodiments, within a ½ inch side space to complement the installation of a ½ inch side space slide if present.
Figure 35:
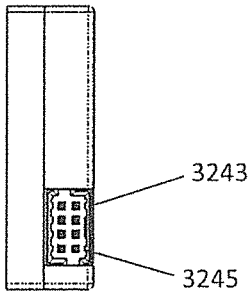
FIG. 35 is a rear view of the motor unit of FIG. 32 showing an on board electrical connector.

As may be partially seen in FIGS. 33 and 34, a contact sensor 3235 is positioned such that the cam stop of the cam arm contacts the contact sensor when the cam arm is in a lowered position. The contact sensor is electrically coupled to control circuitry within the casing for controlling operation of a motor, also within the casing for rotationally driving the cam arm. The control circuitry is also coupled to an electrical connector 3245, as may be seen in FIG. 35, accessible by way of a further opening 3243 in a rear of the casing.

Figure 36:
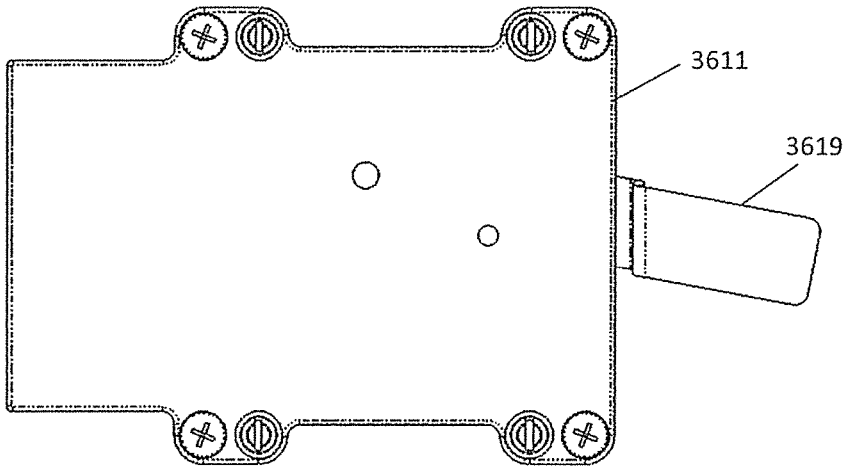
FIG. 36 is a side view of a further motor unit with lifting cam in accordance with aspects of the invention. The lifting arm is shown in the lower position and act similar to the cam arms of other embodiments, with the lifting cam able to bias the gang lock mechanisms and move them in a vertical direction.

FIG. 36 illustrates a yet further motor unit in accordance with aspects of the invention. The motor unit includes a casing 3611 with a frontally protruding lifting arm 3619. In operation, a motor within the motor unit drives the lifting arm up and down. In the embodiment of FIG. 36, the lifting arm includes an offset along its length, which is useful in properly positioning the lifting arm with respect to a lifting platform of a gang-lock device when the motor unit is mounted to a cabinet.

Figure 37:
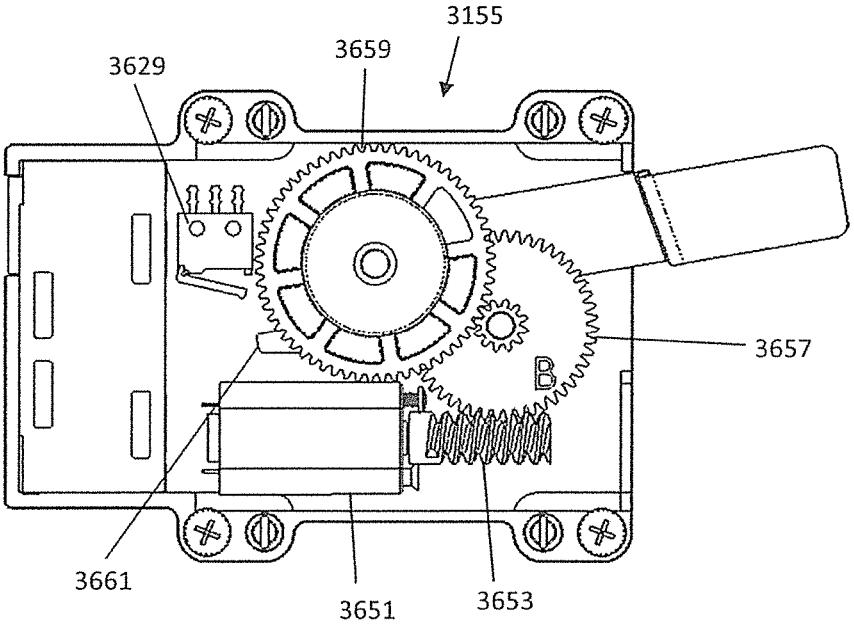
FIG. 37 shows the motor unit of FIG. 36 with a cover removed to show interior components. The interior components include a miniature motor with worm gear connected to a gear set to increase torque.

FIG. 37 shows the motor unit of FIG. 36 with one side of the casing removed. The motor unit includes a motor 3651 which drives a worm gear 3653. The worm gear is connected to a gear set 3655 which drives the lever arm. In the example gear set of the motor unit of FIG. 37, the worm gear drives a larger gear of a compound gear 3657, and a small gear of the compound gear drives a flywheel 3659. The lifting arm is fixedly coupled to the flywheel. Operation of the motor, which is bi-directional, may drive the lifting arm up and down, with FIG. 37 showing the lifting arm in a raised position. The flywheel also includes an extending leg 3661, with a contact sensor 3629 positioned such that the extending leg contacts the contact sensor when the lifting arm is in a fully lowered position.

Figure 38:
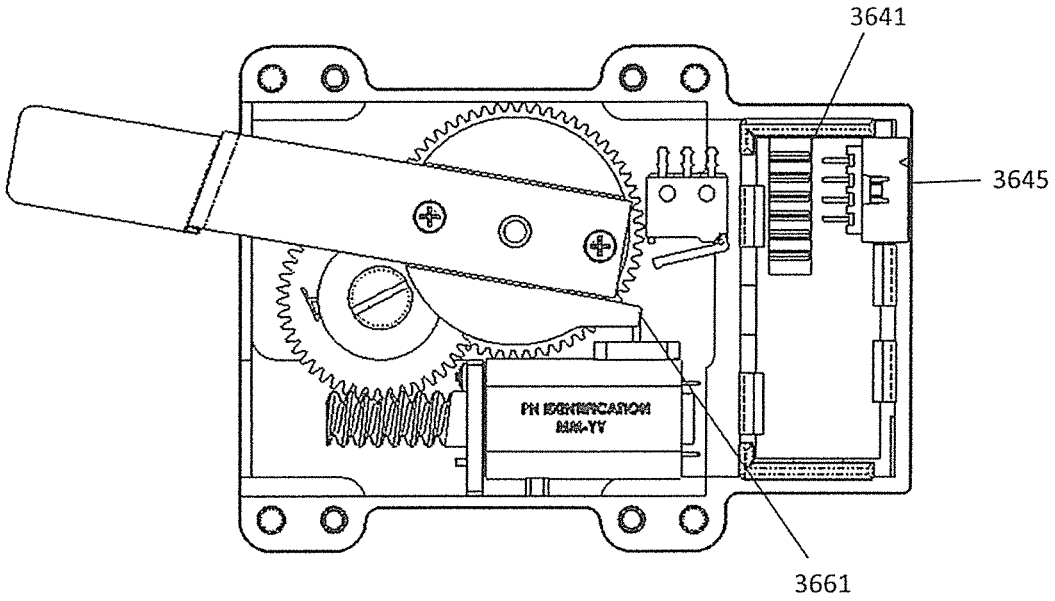
FIG. 38 shows the motor unit of FIG. 36 with the opposite cover removed. The lever arm is attached to a flywheel component integrated to the gear set. The rear of the flywheel incorporates an extension that engages with a contact switch. When the lever is in the up position the extension is not in contact with the switch. The design also incorporates a motor control circuit.

FIG. 38, which shows a view of the motor unit from an opposing side with the other side of the casing removed. As can be seen in FIG. 38, the extending leg is integrally formed with the flywheel, although in some embodiments the extending leg may be a separate structure fixedly mounted to the flywheel by screws, as is the lifting arm. Also as indicated in FIG. 38, the motor unit includes a board 3641 for control circuitry for control of the motor, with the contact sensor also electrically couple to the control circuitry. An electrical connector 3645 also provides external access to the control circuitry, both for control and monitoring purposes in various embodiments.

Figure 39:
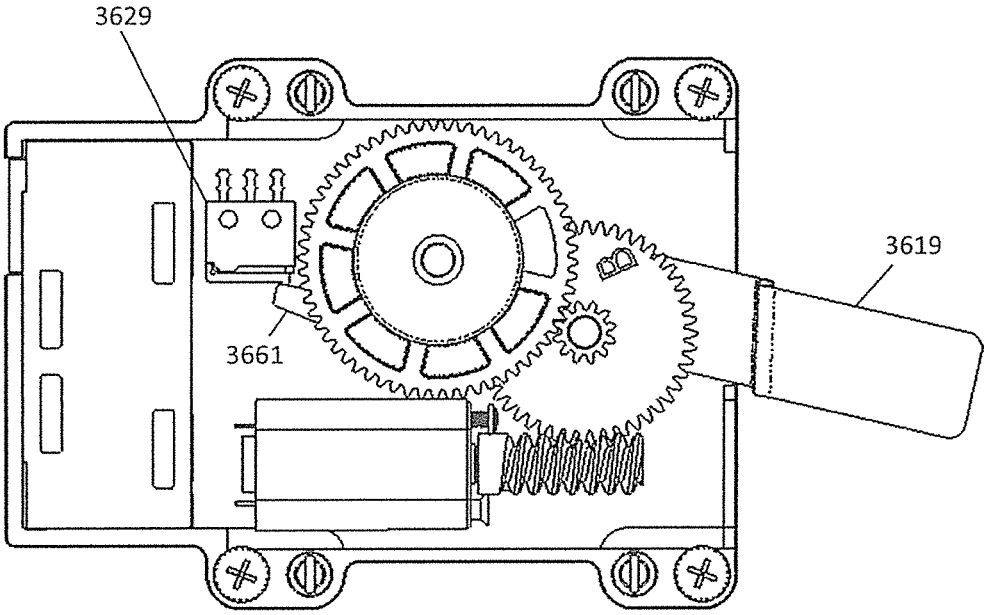
FIG. 39 shows the view of FIG. 37, with the lever in the lower position and the extension of the flywheel engaged with the contact switch.

FIG. 39 shows the view of FIG. 37, but with the lifting arm 3619 in the lowered position. With the lifting arm in the lowered position, the extending leg has closed the switch of contact sensor 3629. In various embodiments the status of the switch is provided to the control circuitry, with the control circuitry stopping the motor upon closing of the switch until an unlock command, for example received by way of the electrical connector, is received.

Figure 40:
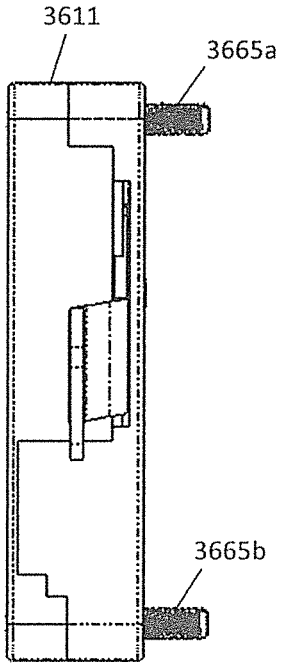
FIG. 40 shows a front view of the motor unit of FIG. 36 with the cover in place. Screws shown are to attach the lock mechanism to the cabinet or other fixed surface. The thickness of the motor unit, not including the extending screws, is less than ½ inch in various embodiments. With the lever arm located to the approximate center of the profile the design allows for the lock to be mounted to the left or right side of a cabinet without change of orientation. Accordingly, the screws are also extendable from the opposite side from what is shown.

FIG. 40 shows a front view of the motor unit of FIG. 36. Mounting bolts 3665*a,b* extend exteriorly from a sidewall of the casing 3611, allowing for mounting of the motor unit to a cabinet. In various embodiments the mounting bolts may be instead positioned to extend from the opposing sidewall of the motor unit, allowing for unhanded positioning of the motor unit.

Figure 41:
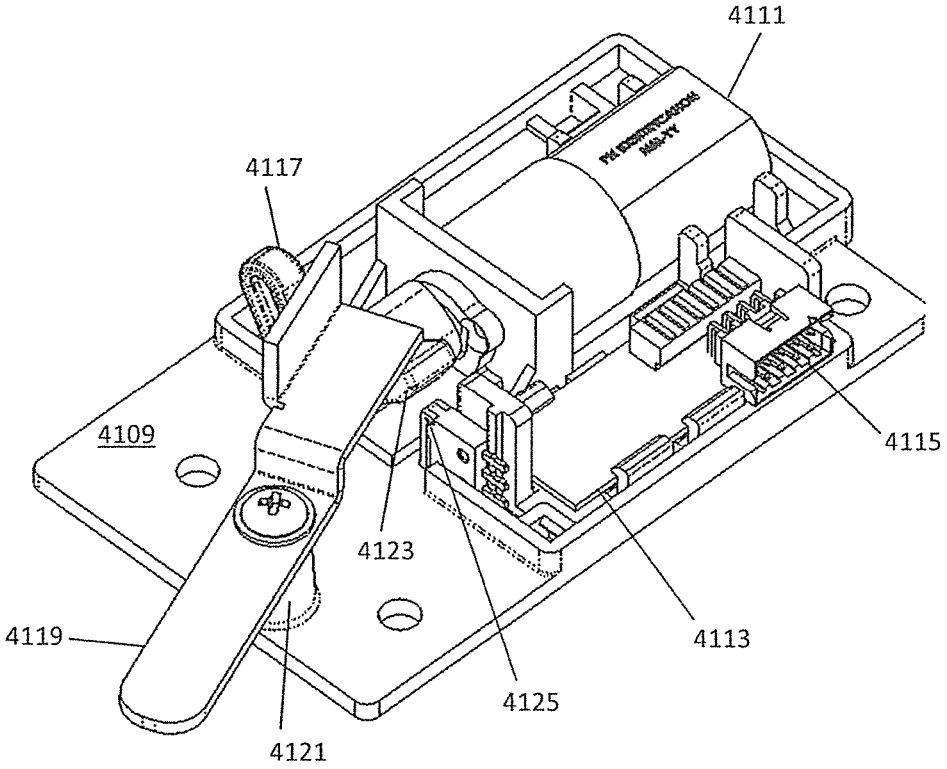
FIG. 41 is an isometric view of a further motor unit in accordance with aspects of the invention. The motor unit includes a miniature gear motor rotating an arm that engages a lever arm. The cover is removed to see the internal components of the lock mechanism. The rotating arm and lever arm are shown in the unlocked position. The lock also incorporates a motor control circuit. This design allows for a snap on cover with mounting holes located on the base plate. This option like the other options is compact in size, in some embodiments measuring approximately 2 inches by 3 inches

FIG. 41 shows a still further motor unit in accordance with aspects of the invention, with a cover of the motor unit removed for increased visibility of components of the motor unit. The motor unit, like the other motor units, includes a motor 4111, a board for control circuitry 4113, and an electrical connector 4115 coupled to the board for providing external access to the control circuitry.

A spindle of the motor drives a cam 4117 which biases a lifting arm rotatably mounted along its length on a spacer 4121 rising above a base 4109 of the motor unit. The lifting arm includes an upturned tab along a rearwardly edge for contact with the cam. The upturned tab provides for increased surface area for contact with the cam, reducing frictional wear of the cam and lifting arm. In addition, the lifting arm includes an offset between the spacer and the cam, allowing for increased distance of movement due to movement of the cam.

As illustrated in FIG. 41, the lifting arm is in a lowered position, with the lifting arm not biased by the tab. The lifting arm may, however, be biased downward by contact with a lifting platform of a gang-lock device, with weight of components attached to the lifting platform driving the lifting arm downward. The cam also includes a protruding tab, which may be termed a stop cam 4123, protruding approximately 90 degrees from the cam. When the lifting arm is moved to a raised position the stop cam contacts a contact sensor 4125, which provides an electrical signal to the control circuitry for use in controlling operation of the motor.

Figure 42:
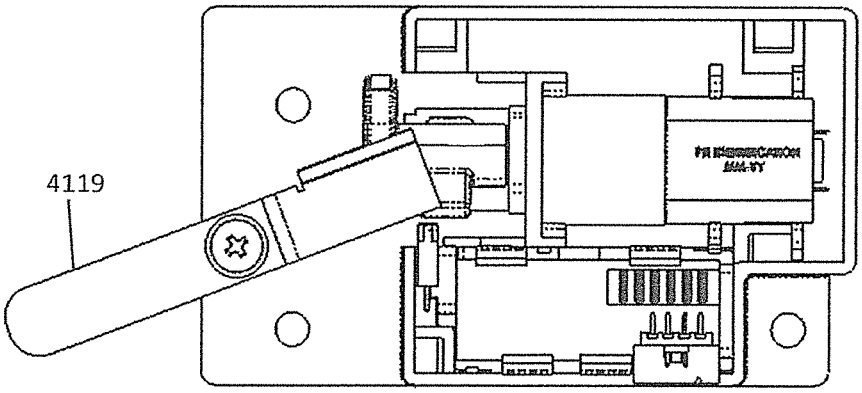
FIG. 42 is a side view of the motor unit of FIG. 41.
Figure 43:
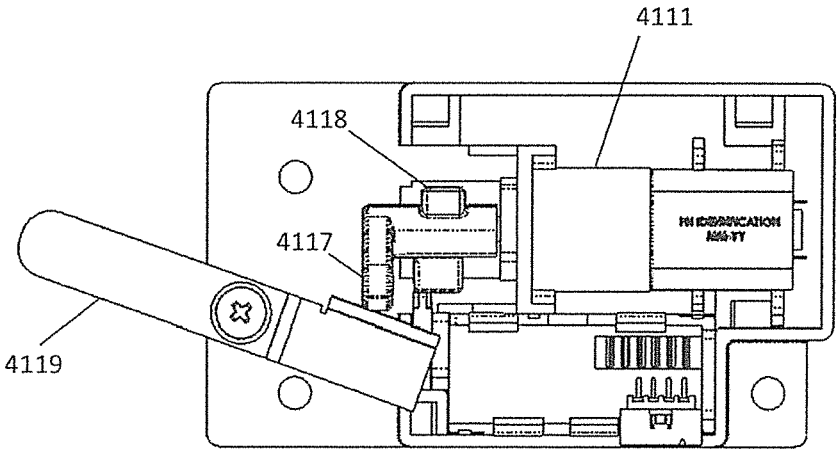
FIG. 43 illustrates the motor unit of FIG. 41 with rotating arm lowered and the lever arm in the up and unlocked position.

FIG. 42 is a side view of the motor unit of FIG. 41, with the lifting arm 4119 in the lowered position. FIG. 43 shows the view of FIG. 42, but with the lifting arm in the raised position. The lifting arm is in the raised position due to rotation of the cam 4117 by the motor 4111, with the result that the cam presses the rear of the lifting arm downward, with rotation of the lifting arm forcing a front of the lifting arm upward. Also visible in FIG. 43 is a further stop cam 4118 protruding from the cam. The further stop cam is positioned such that the further stop cam will contact the base of the motor unit when the cam is rotated to the lowered position (of the lever arm), preventing over rotation of the cam.

Figure 44:
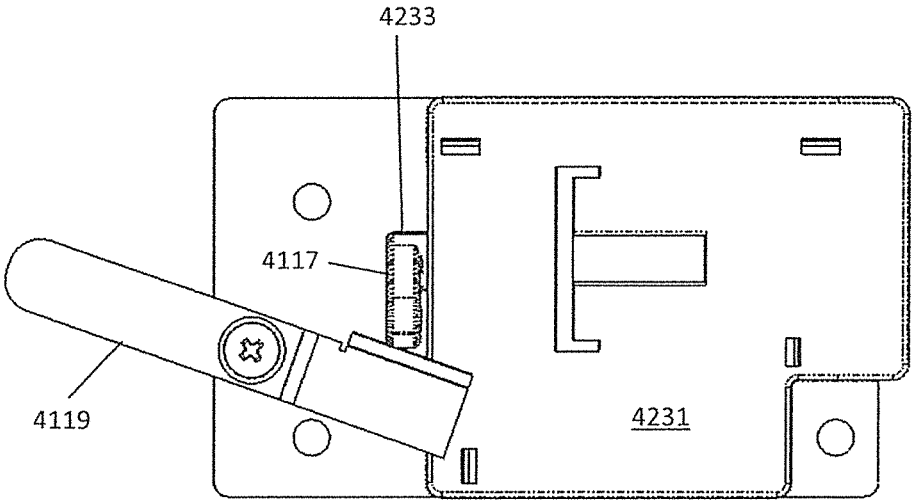
FIG. 44 illustrates the motor unit of FIG. 41 with the cover in place.

FIG. 44 shows the view of FIG. 43, but with a cover 4231 of the motor unit installed. The cover includes an opening 4233 for passage of portions of the cam. As may also be seen in FIG. 44, the lifting arm is mounted to an exterior of the cover.

Figure 45:
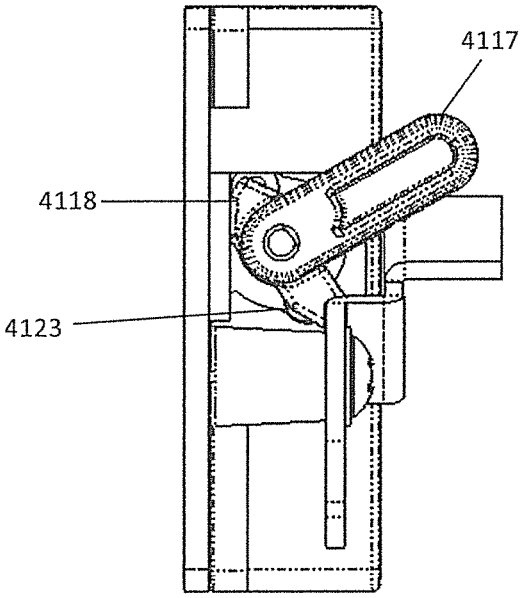
FIG. 45 is a front view of the motor unit of FIG. 41 with the cover in place.

FIG. 45 shows a front view of the motor unit of FIG. 41, showing further details of the cam, stop cam, and further stop cam.

Figure 46:
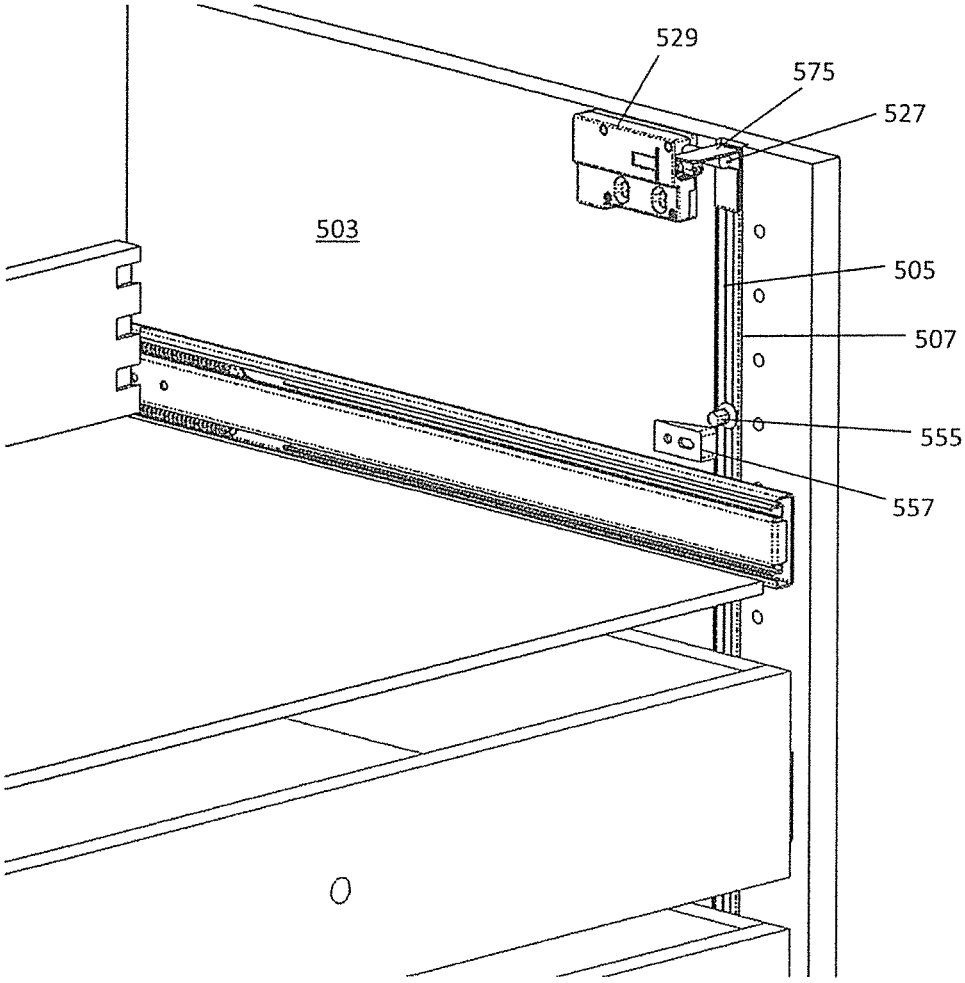
FIG. 46 is an isometric view of yet still another gang lock device in accordance with aspects of the invention mounted at a front of a cabinet. The gang lock device includes a motor unit such as the motor unit of FIG. 6. A lock bar includes a vertical bar with lock pins and a lift platform. The pins, in the locked position, interfere with forward movement of a lock block attached to a drawer. This figure shows the top drawer front and side removed for clarity.

FIG. 46 illustrates a perspective view of a portion of a gang-lock system for a cabinet in accordance with aspects of the invention. A motor unit 529 controls a cam arm 527. The motor unit and cam arm assembly is mounted on the interior surface of a cabinet side panel 503 near a front opening of the cabinet (not shown). When activated by the motor unit 529, the cam arm 527 contacts a platform 575 connected to a locking bar 505, lifting the locking bar 505 vertically along an inset channel 507 in the interior of a cabinet side panel 503. A plurality of bosses 555 are spaced along the locking bar 505 to align with a plurality stops 557 attached to a drawer side panel (not shown). In some embodiments, the bosses 555 are attached to the locking bar with connectors. In other embodiments, the locking bar and bosses are integrally formed. Any lightweight and strong material may be used to form the locking bar and bosses, for example, metal alloys and reinforced polymers. When the cam arm 527 is lowered, the bosses block the path of the stops 557 attached to the drawer side panel. This interference prevents any forward movement of the drawer, thereby placing the system in a locked position. When the cam arm lifts the locking arm, the bosses are moved clear of the stops, and the drawer is free to move forward, placing the system in an unlocked position. As shown in FIG. 46, the cam arm 527 is up, and the system is in an unlocked position.

Figure 47:
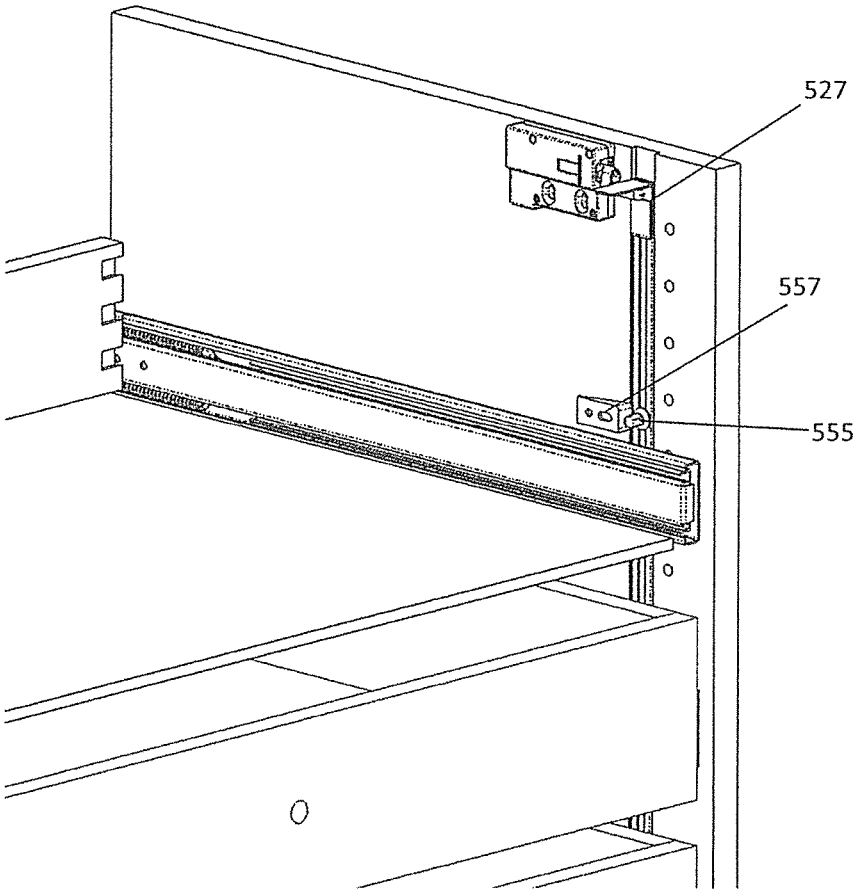
FIG. 47 is an isometric view of the gang lock device in a cabinet of FIG. 46 with the lock bar and pins in the locked position.

FIG. 47 illustrates a perspective view of the portion of a gang-lock system for a cabinet of FIG. 46. The cam arm 527 is lowered, and the bosses 555 block the path of the stops 557, placing the system in a locked position.

Figure 48:
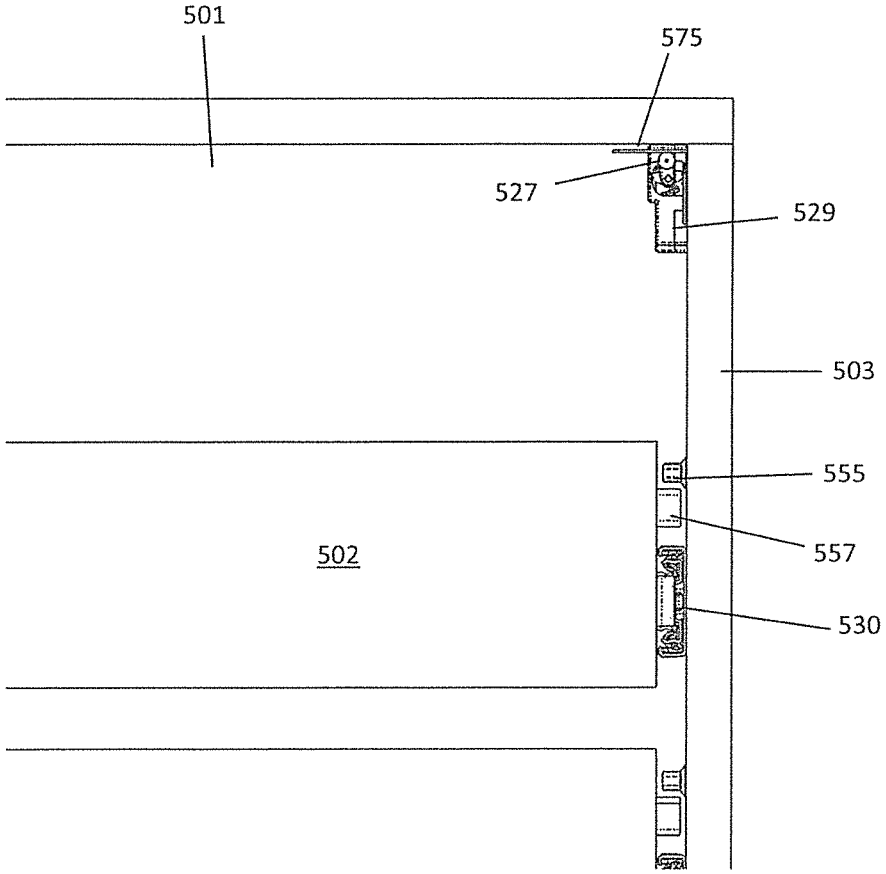
FIG. 48 is a front view of the gang lock device and cabinet of FIG. 46 showing the lock bar in the unlocked position. The lock pin is raised to a point where it avoids interference with the stop block installed on the drawer.

FIG. 48 illustrates a front view of the portion of a gang-lock system for a cabinet of FIG. 46. A motor unit 529 controls a cam arm 527. The motor unit and cam arm assembly is mounted on the interior surface of a cabinet side panel 503 near a front opening of the cabinet 501. The motor unit 529 has activated the cam arm 527 and caused the platform 575 connected to a locking bar (not shown) to lift vertically. The bosses 555 have moved clear of the stops 557, and the drawer 502 is free to move forward on the drawer slide 530.

Figure 49:
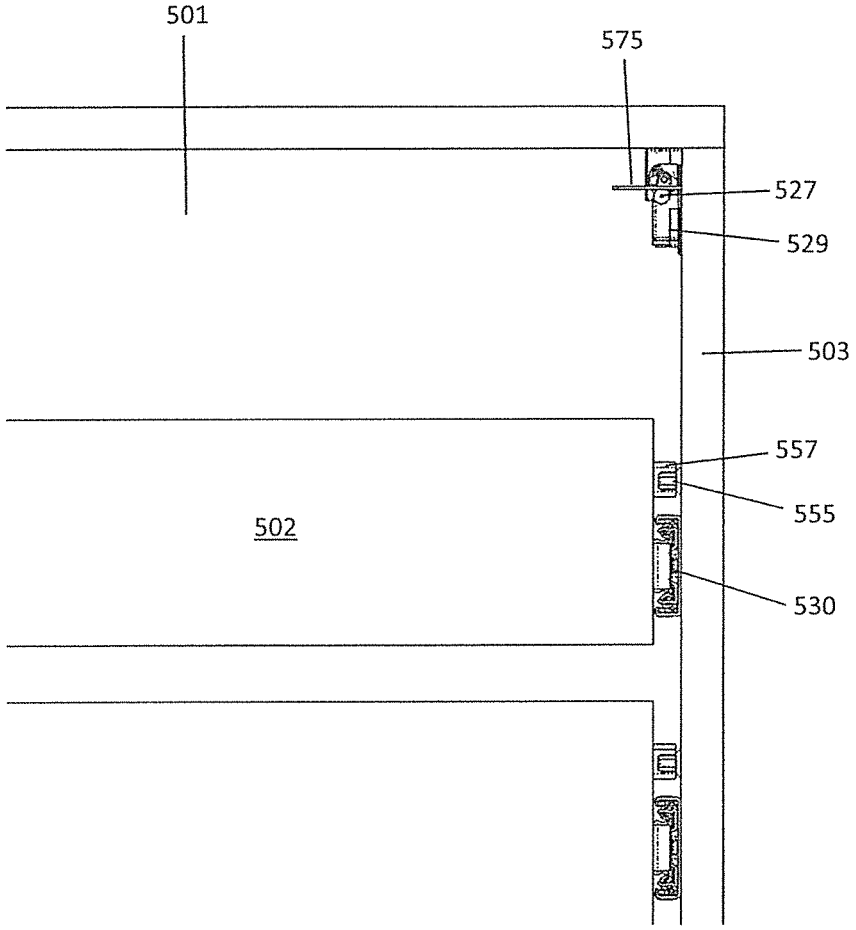
FIG. 49 is a front view of the gang lock device and cabinet of FIG. 46 showing the lock bar in the locked position. The lock pin is lowered to a point where it creates interference with the stop block installed on the side of the drawers, preventing the drawers from opening.

FIG. 49 illustrates a front view of the portion of a gang-lock system for a cabinet of FIG. 48. A motor unit 529 controls a cam arm 527. The motor unit and cam arm assembly is mounted on the interior surface of a cabinet side panel 503 near a front opening of the cabinet 501. The motor unit 529 has lowered the cam arm 527 and caused the platform 575 connected to a locking bar (not shown) to fall vertically under the force of gravity. The bosses 555 have moved in front of the stops 557, blocking their forward path. The drawer 502 is prevented from moving forward on the drawer slide 530, and the system is in a locked position.

Figure 50:
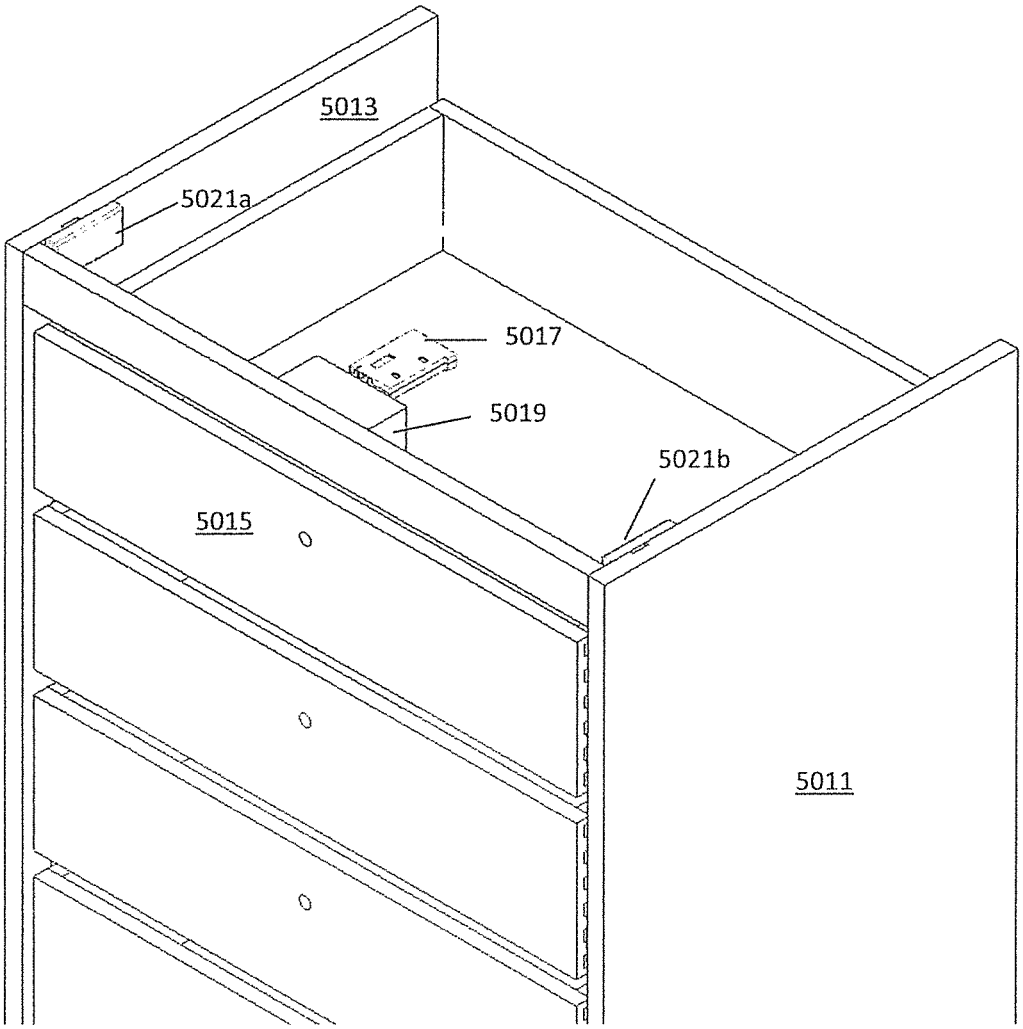
FIG. 50 is an isometric view of portions of a gang lock device and cabinet in accordance with aspects of the invention. The cabinet is shown with its countertop removed for clarity.

FIG. 50 illustrates a cabinet with a locking system in accordance with aspects of the invention. The cabinet includes opposing sidewalls 5011, 5013. Drawers, for example a top drawer 5015, are mounted between the sidewalls. For increased clarity the cabinet is shown without its countertop, which would normally cover a top of the cabinet.

A motor unit 5017 is mounted between the top drawer and the countertop. The motor unit may be, for example, a motor unit as discussed with respect to FIGS. 6-10 or other figures. The motor unit is coupled to a central locking mechanism 5109. The central locking mechanism is linked through linkages (not shown in FIG. 50) to mechanisms 5021*a,b* on the opposing side walls. The linkages may be, for example, cables or rods. The mechanisms 5021*a,b* are coupled to vertical lock bars that extend down along the sidewalls of the cabinet, between the sidewalls and the drawers. The mechanisms 5021*a,b* translate motion of the cables or rods into vertical displacement of locking bars extending down between the side walls and drawers of the cabinet.

In most embodiments the motor unit includes a rotatable cam arm extending forward of an opening of a casing of the motor unit. The arm interacts with components of the central locking mechanism. Interaction of the arm of the motor unit with components of the central locking mechanism results in motion of the cables or rods. For example, in some embodiments cables may be coupled between a hub of the central locking mechanism and the mechanisms 5021*a,b*. Rotation of the arm of the motor unit may cause rotation of the hub, so as to pull the cables towards the central locking mechanism or to decrease tension in the cables. In some embodiments, pulling of the cable toward the central locking mechanism may cause the mechanisms 5021*a,b* to raise the locking bars, while conversely a decrease in tension of the cables may allow the locking bars to lower or fall, for example due to their own eight.

Figure 51:
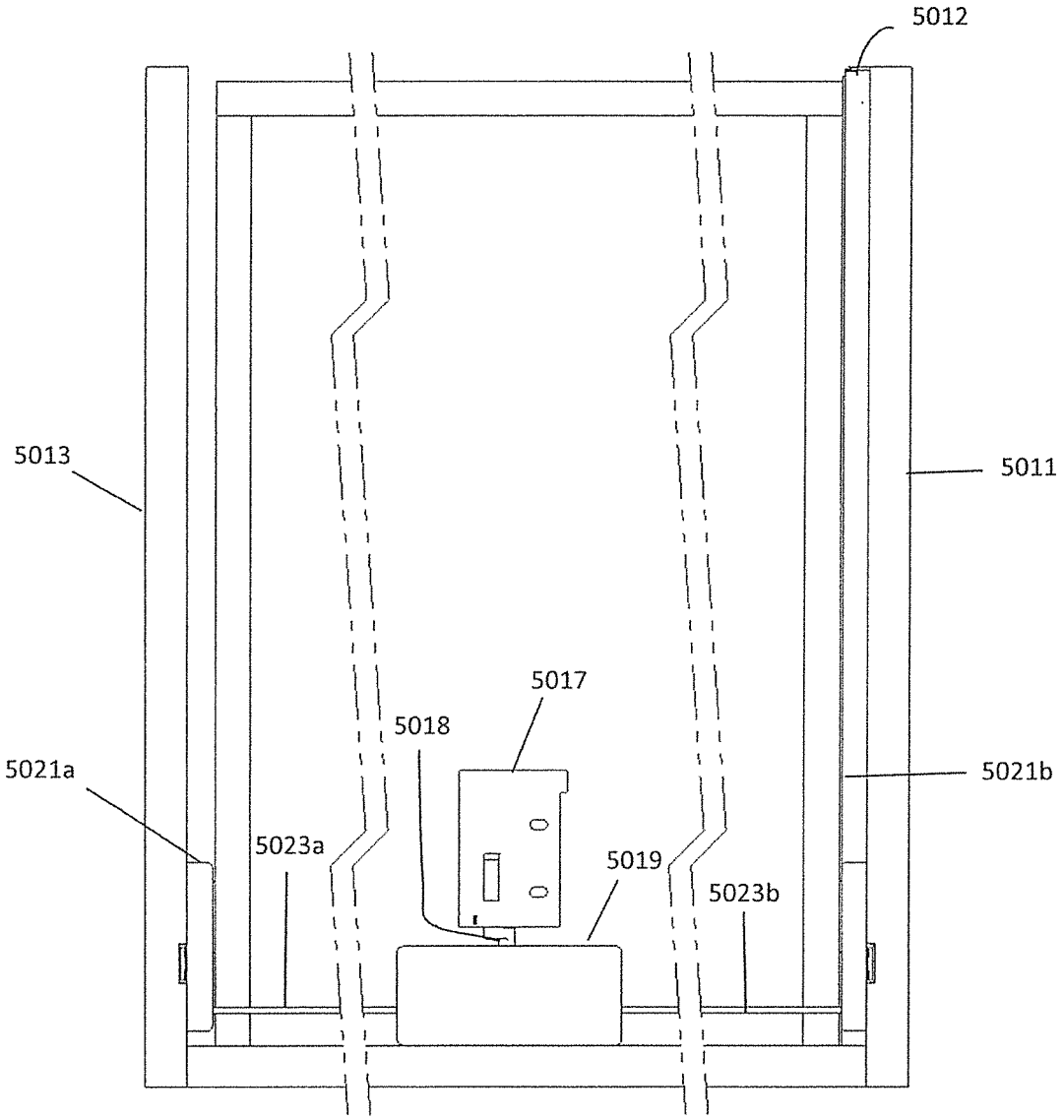
FIG. 51 is a top view of the cabinet of FIG. 50, with drawer slides omitted from the left side of the cabinet for clarity.

FIG. 51 is a top view of the cabinet with the locking system of FIG. 50. In FIG. 51 the cam arm 5018 of the motor unit may be seen, with a portion of the cam arm entering the central locking mechanism, allowing for interaction with components of the central locking mechanism. In FIG. 51, cables 5023*a,b* couple the central locking mechanism to the mechanisms 5021*a,b*, although in various embodiments rods or other linkages may be used. Also as may be seen in FIG. 51, drawer slides couple drawers of the cabinet with the cabinet sidewalls, with only a drawer slide 5012 for the top drawer visible in FIG. 51 (and the drawer slides for the left side of the cabinet omitted for clarity).

Figure 52:
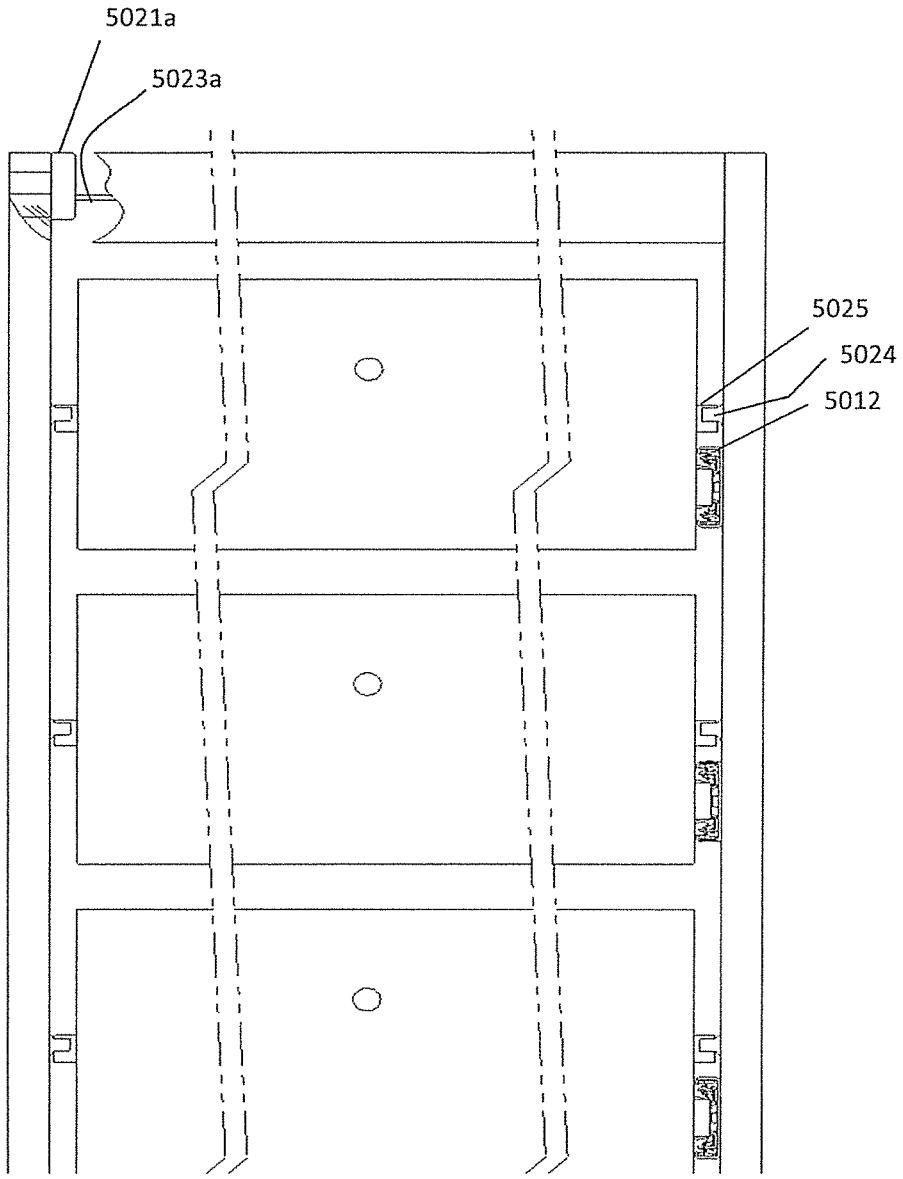
FIG. 52 is a front sectional view of the cabinet of FIG. 50, with drawer slides again omitted from the left side of the cabinet for clarity.

FIG. 52 is a front sectional view of the cabinet and locking system of FIG. 50, with again drawer slides for a left side of the cabinet omitted for clarity. As may be seen in FIG. 52, the drawers are coupled to the cabinet sidewalls by drawer slides, for example drawer slide 5012 for the top drawer. The drawer slides normally allow for the drawers to be extended from the cabinet, for easy access to the contents of the drawers. Bosses, for example boss 5024 for the top drawer, extend from the locking bars inward towards the center of the cabinet, in the space between the cabinet sidewalls and drawers. With the locking bars in a locked position, a lowered position in some embodiments, the bosses are in front of stops 5025 attached to the drawers. The bosses thereby block forward, opening motion of the drawers, effectively locking the drawers within the cabinet. The bosses and the stops may be as discussed with respect to FIG. 46.

Figure 53:
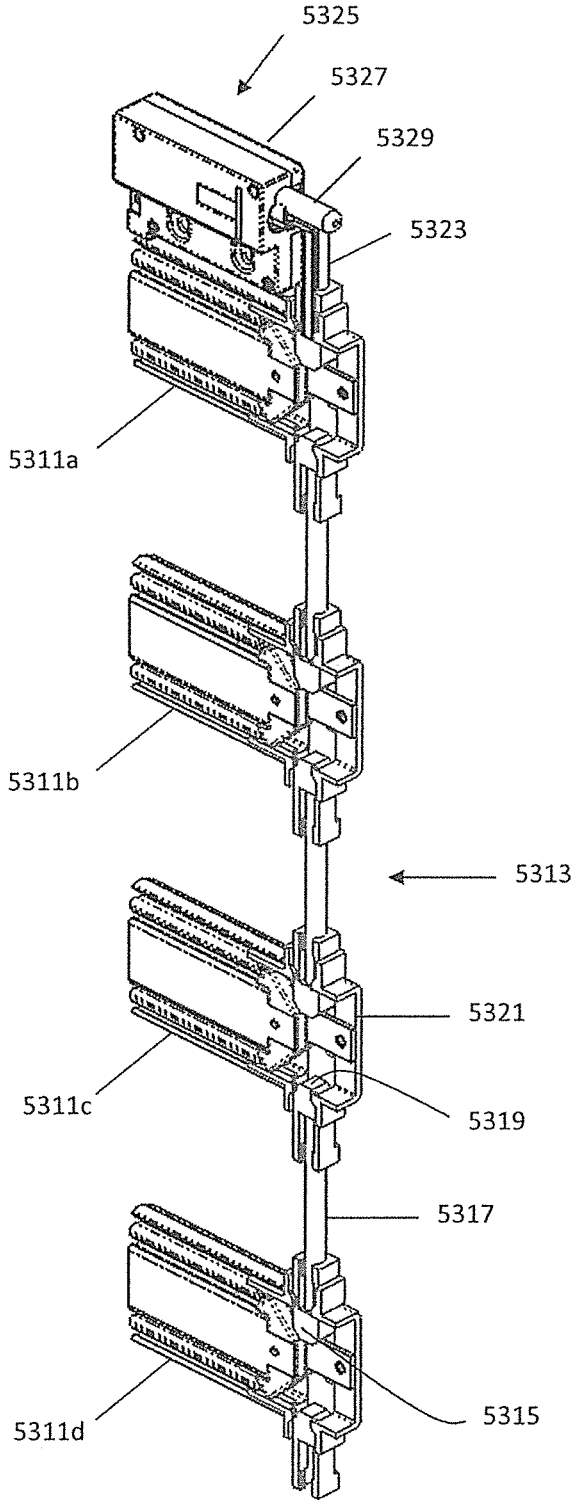
FIG. 53 illustrates portions of a further gang lock mechanism in accordance with aspects of the invention. In the embodiment of FIG. 54, a motor unit in conjunction with a drawer interlock system provides a gang lock mechanism.
Figure 54:
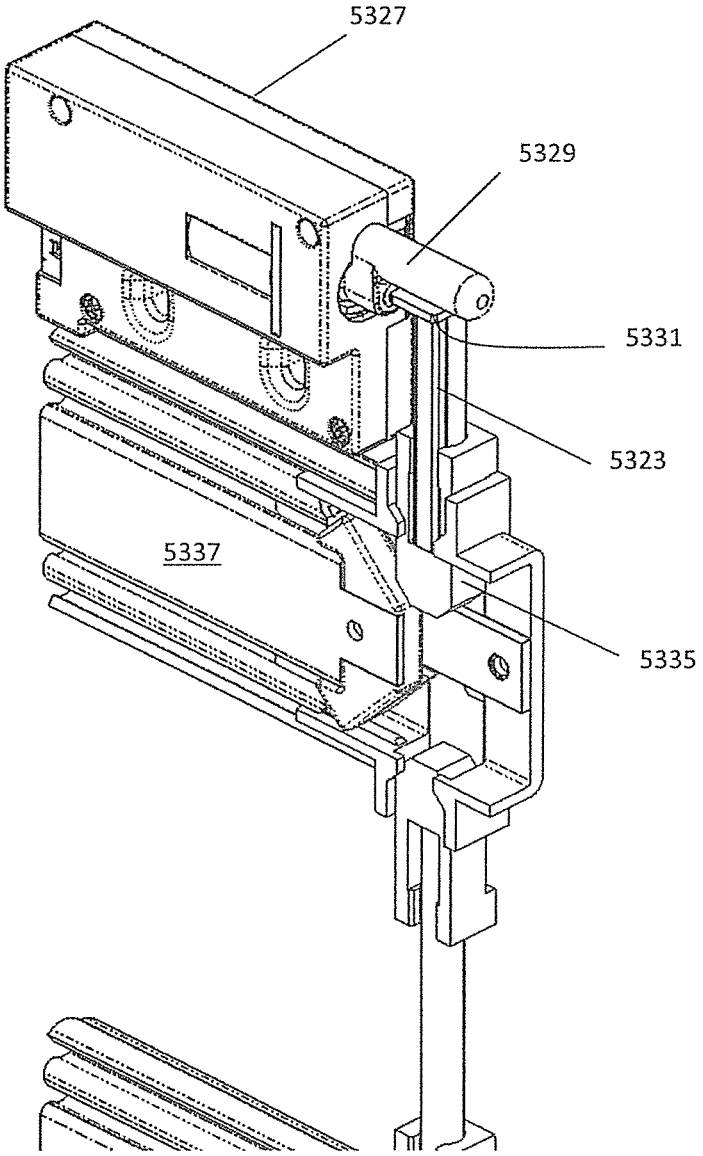
FIG. 54 illustrates a close up view of portions of the mechanism of FIG. 53.

FIG. 53 illustrates portions of a further gang lock mechanism in accordance with aspects of the invention. In the embodiment of FIG. 54, a motor unit in conjunction with a drawer interlock system provides a gang lock mechanism.

The embodiment of FIG. 53 shows four drawer slides 5311*a-d* interconnected by an interlock device 5313. The four drawer slides would generally extendably couple corresponding drawers within a cabinet, with the four drawer slides along one side of the interior of the cabinet and opposing drawer slides along an opposing side of the interior of the cabinet. Although only four drawer slides are shown, with an additional opposing four drawer slides implied, a greater or lesser number of slides may be used, for example to support a greater or lesser number of cabinet drawers.

The interlock device may be, for example, an interlock device as discussed in U.S. Pat. Nos. 5,988,778 or 6,296,332, the disclosures of both of which are incorporated by reference in their entirety. As shown in FIG. 53, and considering portions from about a top of the slide 5311*d* to about the top of the above adjacent slide 5311*c*, the interlock device includes a rod 5317 between adjacent slides. An upper actuator follower 5315 is coupled to a lower end of the rod, and a lower actuator follower 5319 is coupled to an upper end of the rod. The upper actuator follower extends into a travel path of an extendable slide member of the slide 5311*d*, and the lower actuator follower is extendable into a travel path of an extendable slide member of the slide 5311*c*. Considering the relative position of the actuator followers with respect to the slides whose travel is impacted by the actuator followers, it may be seen that travel of each slide may be impacted by two actuator followers, one from below the slide and hence termed a lower actuator follower, and one from above the slide and hence termed an upper actuator follower. In operation, extension of the slide 5311*d* causes the upper actuator follower to displace upward, with the rod also therefore displacing upward. The upward displacement of the rod results in upward displacement of the lower actuator follower, which displace into a travel path of the slide 5311*c*, blocking extension of the slide 5311*c*. Moreover, a rod for the next adjacent slide in the sequence of drawer slides is coupled to the rod 5317 by way of a portion of the lower actuator follower (and next above upper actuator follower) inset into a forward portion 5321 of the slide 5311*c*, causing rods further upward to also displace upward, along with their associated lower actuator followers, blocking extension of slides above the extended slide. In addition, extension of one slide blocks motion of a corresponding lower actuator follower into the travel path of that slide, with the result that the upper actuator followers below that slide block extension of slides below that slide.

An uppermost rod 5323 is above a highest slide in the sequence of drawer slides, with in this example the highest slide being the drawer slide 5311*a*. A motor unit 5325 is also above the highest slide. The motor unit, in various embodiments, may be a motor unit the same as or similar to the motor unit of FIGS. 6-10, or other figures. As illustrated in FIG. 53, the motor unit includes a housing 5327, with a rotatable cam arm 5329 extending from the casing. The motor unit is proximate the uppermost rod, with the rotatable cam arm 5329 positionable to either allow upward movement of the uppermost follower or to block upward movement of the uppermost rod. As illustrated in FIG. 53, the rotatable cam arm blocks upward movement of the uppermost rod. As a result, the uppermost rod may not displace upward, none of the rods below may displace upward, and none of the upper actuator followers below may displace upward. The upper actuator followers therefore block extension of the drawer slides, and the slides are effectively locked in the closed position.

FIG. 54 illustrates a close up view of portions of the mechanism of FIG. 53. FIG. 54 shows, for example, portions of the uppermost slide, including its inner slide member 5337, which is usually mounted to a drawer or the like and is extendable forward. From FIG. 54, it may also be seen that an upper actuator follower 5335 of the uppermost rod 5333 blocks extension of the inner slide member, unless the inner slide member is able to displace the upper actuator follower upward. A pedestal 5331 may also be seen atop the uppermost rod in FIG. 54, with the pedestal integrated with the rod in the embodiment of FIG. 54, and with the rotatable cam arm sitting atop the pedestal and therefore blocking upward movement of the pedestal and uppermost rod.

Figure 55:
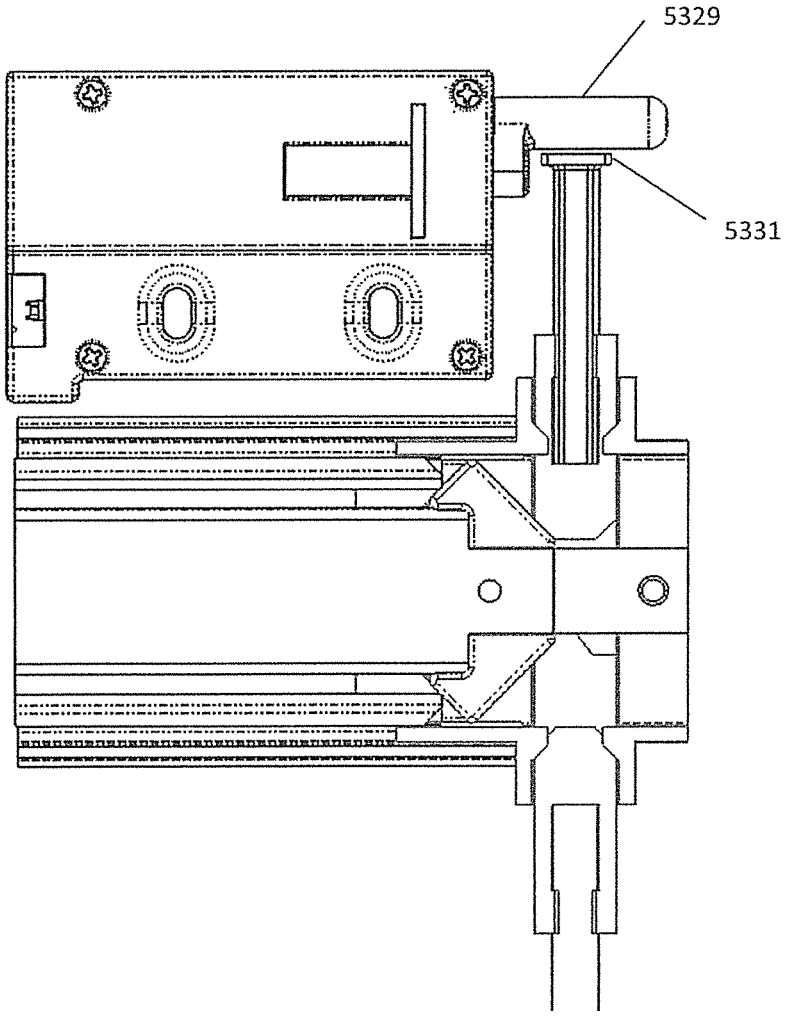
FIGS. 55, 56, and 57 are left side, front, and right side views for portions of the mechanism shown in FIG. 54.
Figure 56:
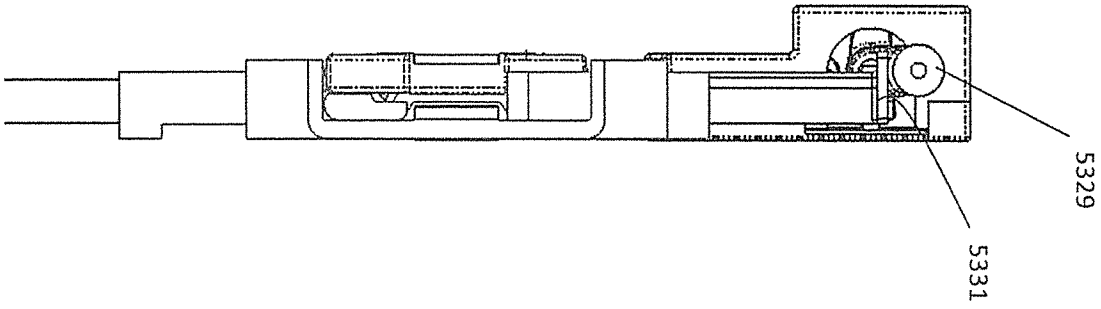
Figure 57:
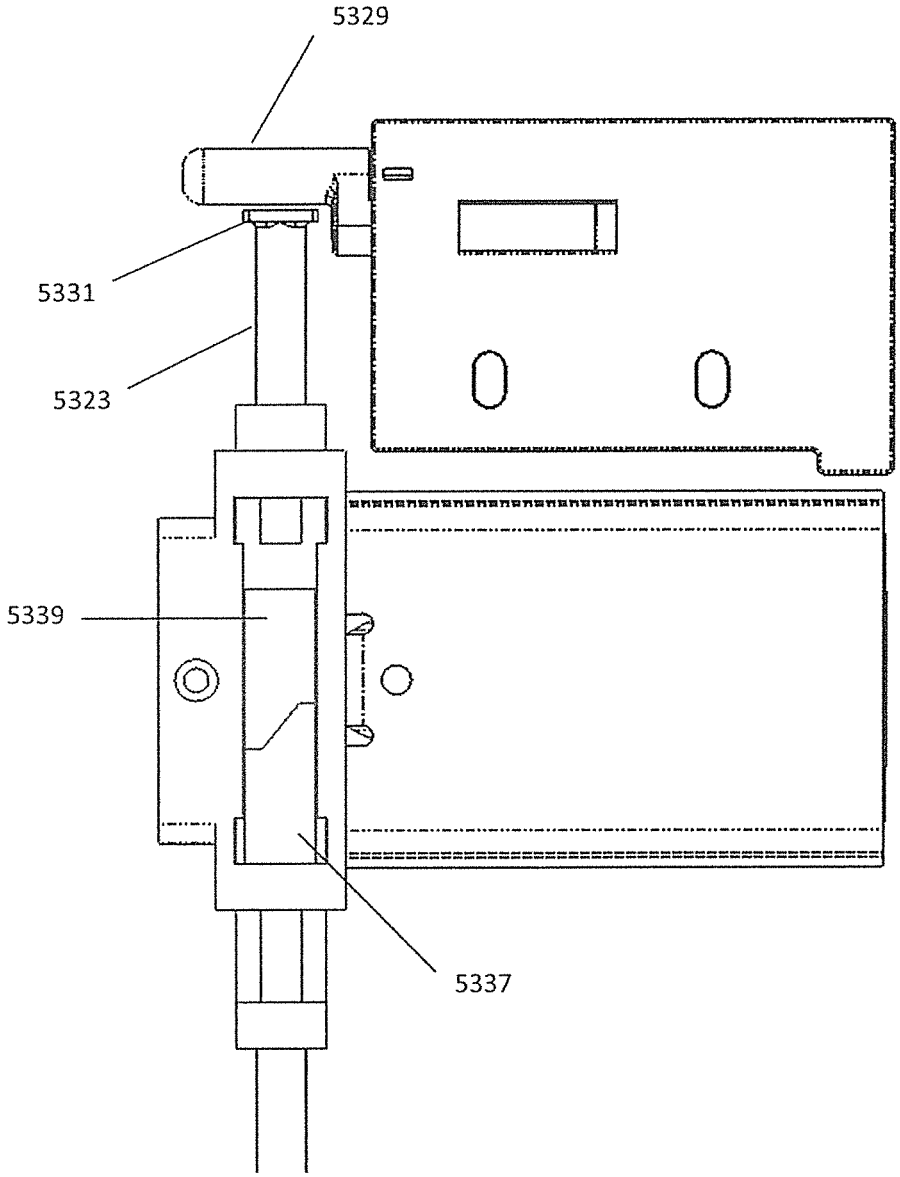

FIGS. 55, 56, and 57 are left side, front, and right side views for portions of the mechanism shown in FIG. 54. All three of these views show the rotatable cam arm atop the pedestal, with the front view of FIG. 56 also showing that the pedestal extends laterally beyond edges of the uppermost rod, allowing for increased ease of positioning of the motor unit relative to the uppermost rod. In addition, the right side view of FIG. 57 shows a portion 5339 of the upper actuator follower extending into an area alongside the upper slide, with a portion 5337 of an immediately below lower actuator follower also extending into an area alongside the upper slide, such that upward motion of the portion 5337 results in upward motion of the portion 5339. Contacting parts of the two portions include an angled segment, so as to increase assurance that at least part of the portions will not clear areas alongside the slide member during operation.

Figure 58:
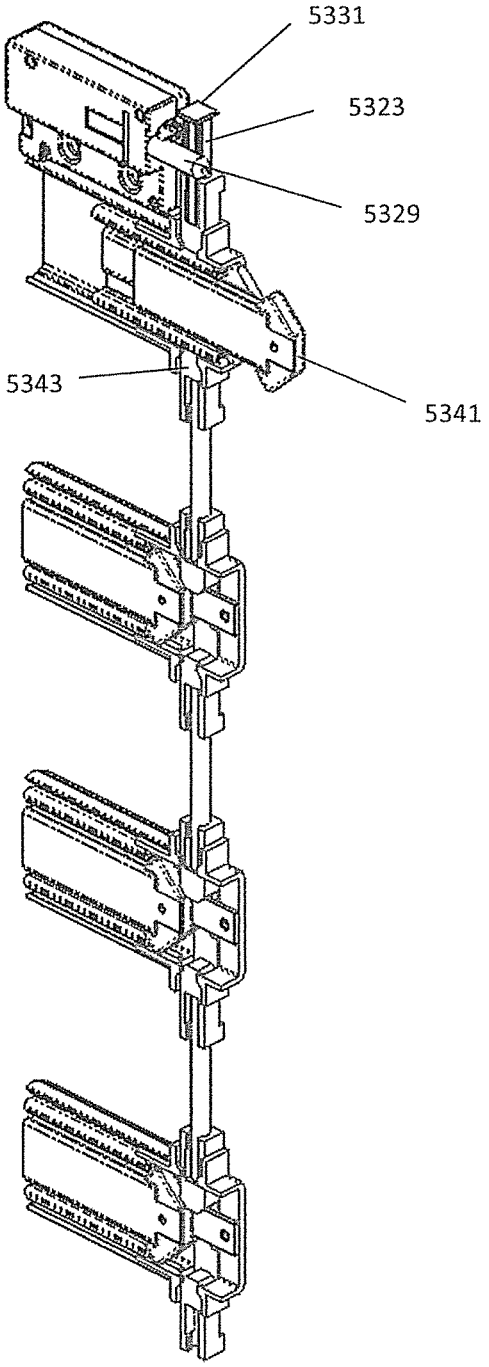
FIGS. 58-62 correspond to FIGS. 53-57, respectively, but with the inner slide member of the uppermost slide partially extended
Figure 59:
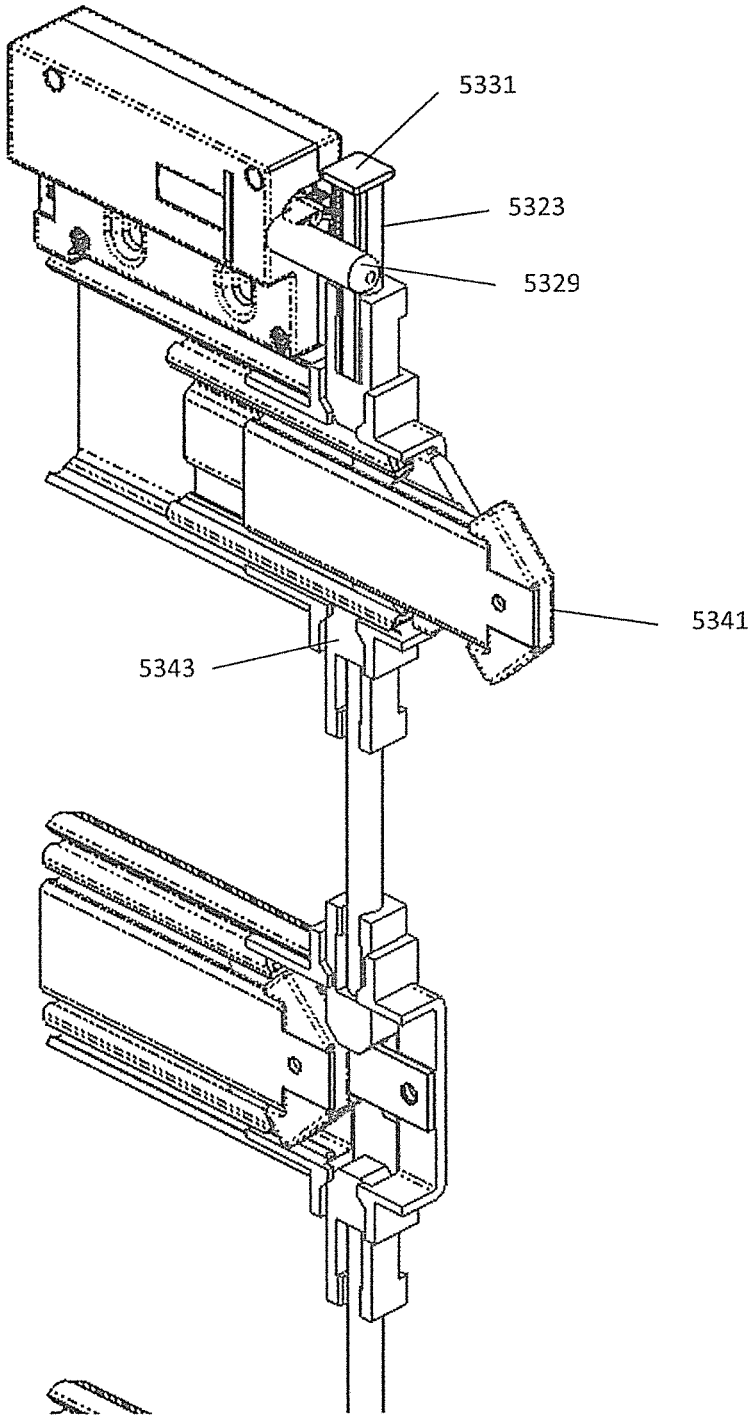
Figure 60:
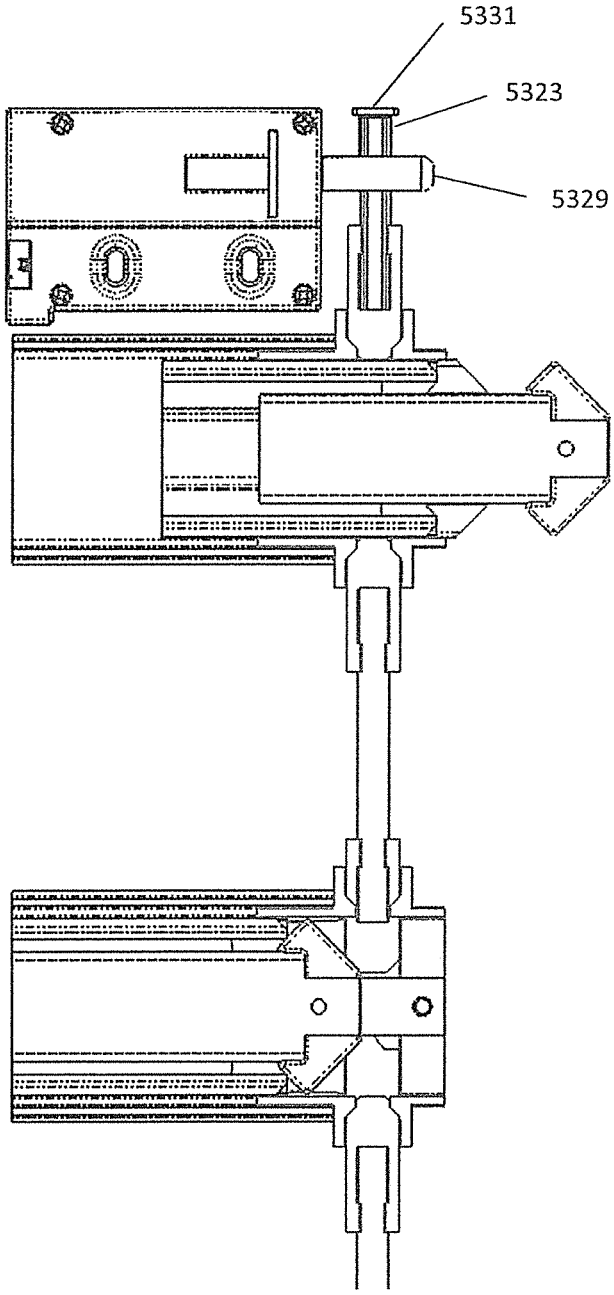
Figure 61:
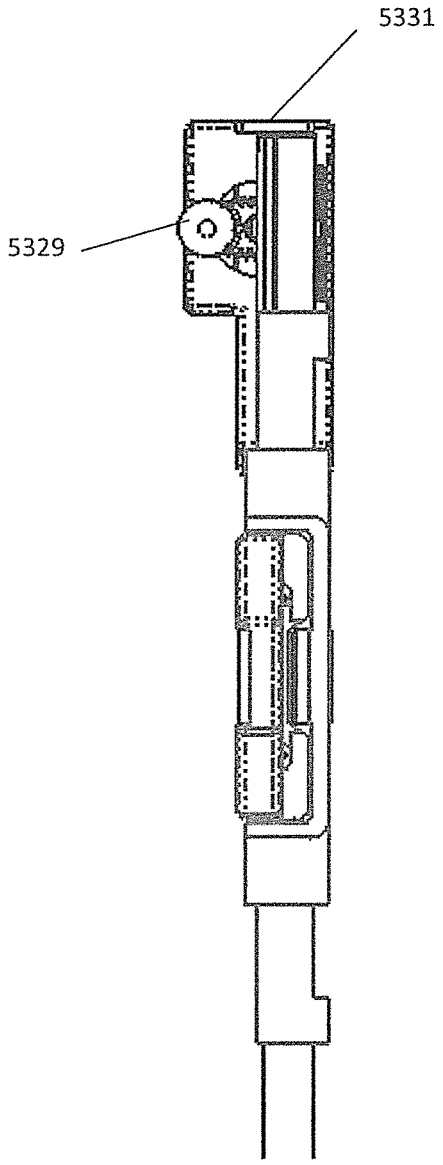
Figure 62:
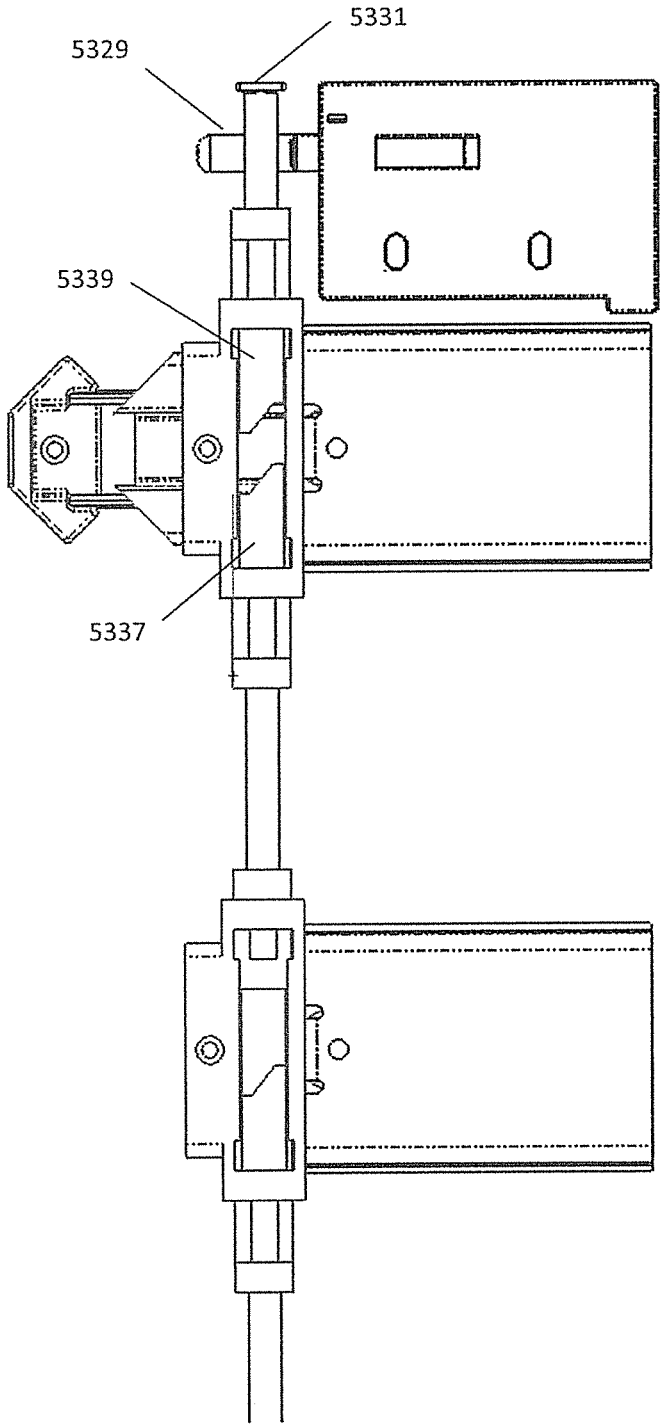

FIGS. 58-62 correspond to FIGS. 53-57, respectively, but with the inner slide member of the uppermost slide partially extended. As may be seen in FIG. 58, the rotatable cam arm 5329 has been rotated to a position laterally to the side of the pedestal 5331 and uppermost rod 5323, allowing the pedestal and uppermost rod to vertically displace through contact with portions of the inner slide member, or an attachment to the inner slide member as shown in FIG. 58, for example. A lower actuator follower of the rod below the upper slide member, however, may not be vertically displaced, as the extended inner slide member blocks such displacement. As a result, the rods below the uppermost slide may not be vertically displaced upward, and the upper actuator followers of the rods block extension of the other slides.

Figure 63:
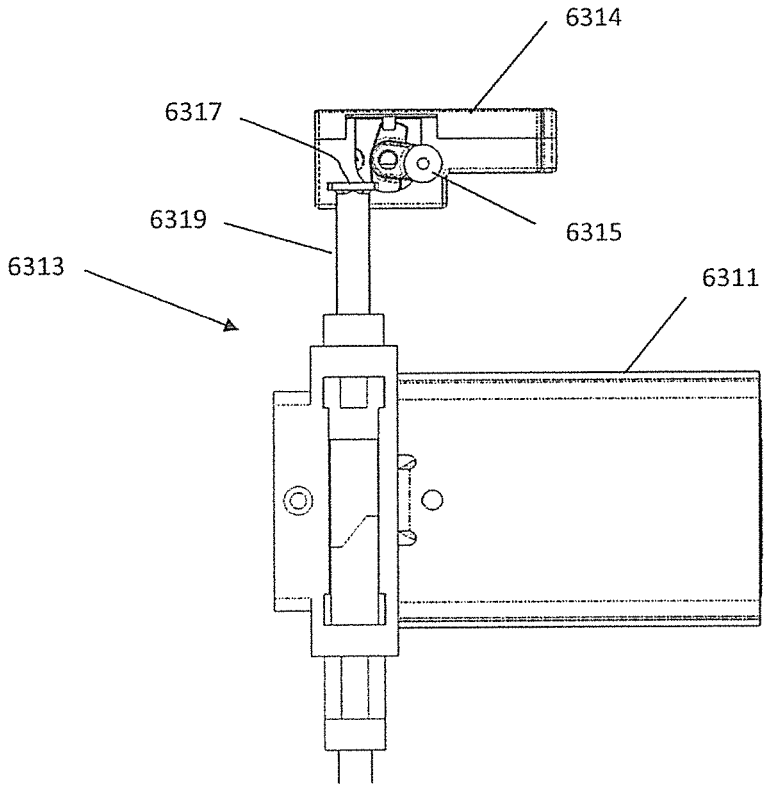
FIGS. 63 and 64 show a portion of gang lock mechanism similar to that of FIGS. 53-62, but with the motor unit in an alternative position with respect to the interlock assembly.
Figure 64:
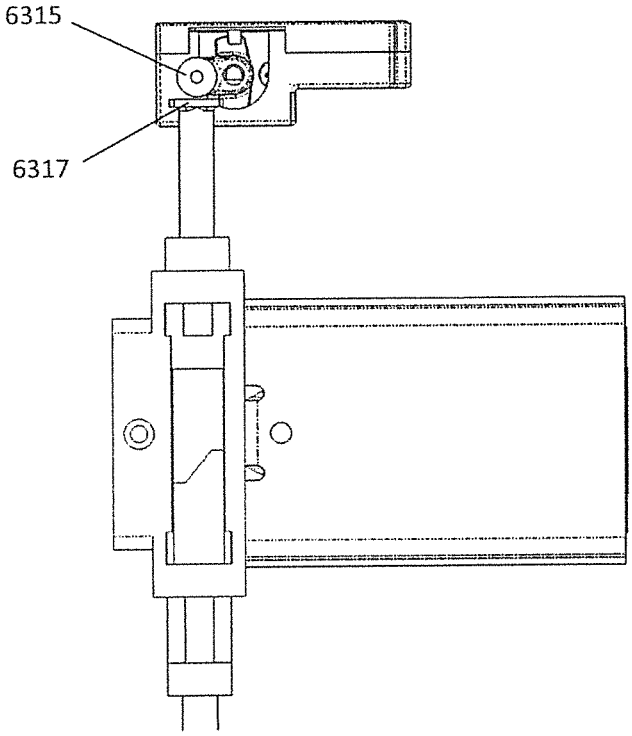

FIGS. 63 and 64 show a portion of gang lock mechanism similar to that of FIGS. 53-62, but with the motor unit in an alternative position with respect to the interlock assembly. FIG. 63 shows a single drawer slide 6311 coupled about its forward edge to an interlock system 6313. Although only a single slide is shown in FIG. 63, generally a plurality of slides would be used within a cabinet including the slides and gang lock mechanism. An upper rod 6319 of the interlock system includes an integrated pedestal 6317 on the top of the rod. A motor unit is positioned horizontally, compared to a vertical position of FIGS. 53-62, with the motor unit including a housing 6314 and an extending rotatable cam arm 6315. Horizontal positioning of the motor unit may allow the motor unit to be more easily mounted to an underside of a top of a cabinet, for example.

As illustrated in FIG. 63, the rotatable cam arm is in an unlocked position, with the cam arm not blocking upward vertical displacement of the pedestal and upper rod. FIG. 64, to the contrary, shows the cam arm in a locked position, with the cam arm 6315 blocking upward displacement of the pedestal 6317.

Although the invention has been discussed with respect to various embodiments, it should be recognized that the invention comprises the novel and non-obvious claims supported by this disclosure.

What is claimed is:

1. A locking system for a cabinet including a plurality of drawers extendably mounted in an interior of the cabinet, the locking system comprising:

a bar movable to prevent at least some of the drawers from extending out of the cabinet when in a locked position and allowing at least one of the drawers to extend out of the cabinet in an unlocked position; and a platform connected to and extending from the bar;

a motor unit having a casing having at least a portion sized to fit within a width of a space between a drawer and a cabinet sidewall, with a motor within the casing to drive, within the casing, a cam arm extending from an opening in the casing, the cam arm drivable to contact and lift the platform to change a position of the bar from the locked position to the unlocked position;

wherein a first sensor is positioned in the casing of the motor unit to detect when the cam arm is in a first predefined position, and a second sensor is positioned in the casing of the motor unit to detect when the cam arm is in a second predefined position, and the first sensor and the second sensor are electrically coupled to control circuitry for operating the motor driving the cam arm;

wherein a first cam stop extends radially from the cam arm and is configured to trip the first sensor, and a second cam stop extends radially from the cam arm and is configured to trip the second sensor, and wherein the casing includes a pair of apertures for mounting the casing to a cabinet side panel.

2. The locking system of claim 1, wherein the first sensor is a contact sensor.

3. The locking system of claim 1, wherein the bar is a serpentine rod with portions of the serpentine rod positioned in a slot of a bracket attached to the drawer in the locked position, and the motor unit is configured to drive the portions of the serpentine rod out of the slot.

4. The locking system of claim 1, further comprising a mechanical lock configured to drive a mechanical lock arm coupled to the bar, the mechanical lock arm being drivable to change the position of the bar from the locked position to the unlocked position independently of the motor unit.

5. A locking system for a housing, the housing containing a plurality of inner slide members slidably coupled to the housing, the locking system including:

a restricting element movable to prevent at least more than one of the inner slide members from sliding at least partially out of the housing when in a locked position and allowing at least one of the slides to slide out of the housing in an unlocked position; and an electrically powered driving unit coupled to the restricting element, and drivable to shift a position of the restricting element from the locked position to the unlocked position, the electrically powered driving unit including a casing having at least a portion sized to fit within a width of a space between a drawer and a cabinet sidewall, a motor with an extending spindle and a cam, the cam drivable within the casing by the motor by way of the spindle, with the cam positionable to urge against the restricting element to move the restricting element out from the locked position.

6. The locking system of claim 5, wherein the restricting element is movable to prevent all of the plurality of inner slide members from sliding at least partially out of the housing in the locked position and to allow all the slides to slide out of the housing in the unlocked position.

7. The locking system of claim 5, further comprising a mechanical lock configured to drive a mechanical lock arm coupled to the restricting element, the mechanical lock arm being drivable to change the position of the restricting element from the locked position to the unlocked position independently of the powered driving unit.

8. The locking system of claim 5, further comprising a sensor within the casing, the sensor electrically coupled to control circuitry for operating the powered driving unit, and configured for detecting when the restricting element is in a predetermined position.

9. The locking system of claim 8, wherein a stop extends radially from the cam and is configured to trip the sensor.

10. The locking system of claim 1, wherein the casing has an upper portion and a lower portion, the upper portion wider than the lower portion.

11. The locking system of claim 10, wherein the lower portion is sized to fit within the width of a space between the drawer and the cabinet sidewall.

12. The locking system of claim 10, wherein the apertures are through the lower portion of the casing.

* * * * *